US008597486B2

(12) United States Patent
Li et al.

(10) Patent No.: US 8,597,486 B2
(45) Date of Patent: Dec. 3, 2013

(54) DROPLET BASED MINIATURIZED DEVICE WITH ON-DEMAND DROPLET-TRAPPING, -FUSION, AND -RELEASING

(75) Inventors: Changming Li, Singapore (SG); Wei Wang, Singapore (SG)

(73) Assignee: Nanyang Technological University, Singapore (SG)

( * ) Notice: Subject to any disclaimer, the term of this patent is extended or adjusted under 35 U.S.C. 154(b) by 80 days.

(21) Appl. No.: 12/827,789

(22) Filed: Jun. 30, 2010

(65) Prior Publication Data

US 2011/0259742 A1 Oct. 27, 2011

Related U.S. Application Data

(60) Provisional application No. 61/326,344, filed on Apr. 21, 2010.

(51) Int. Cl.
*B03C 5/02* (2006.01)

(52) U.S. Cl.
USPC ..... 204/643; 204/547; 204/600; 204/450

(58) Field of Classification Search
USPC ..... 204/600–621, 641–645, 451, 547
See application file for complete search history.

(56) References Cited

U.S. PATENT DOCUMENTS 4,390,403 A * 6/1983 Batchelder ..... 204/547
2005/0179746 A1* 8/2005 Roux et al. ..... 347/69
2006/0153745 A1* 7/2006 Ermakov ..... 422/130
2007/0242105 A1* 10/2007 Srinivasan et al. ..... 347/63
2008/0166720 A1* 7/2008 Hsieh et al. ..... 435/6

OTHER PUBLICATIONS

SRISA-Art, et al., "High-throughput DNA droplet assays using picoliter reactor volumes", *Annal. Chem.*, 79:6682-6689 (2007).
Ahn, et al., "Dielectrophoretic manipulation of drops for high-speed microfluidic sorting devices" , Applied Physics Letters, 88(2):024104 (2006).
Ahn, et al., "Electrocoalescence of drops synchronized by size-dependent flow in microfluidic channels", Applied Physics Letters, 88(2):264105 (2006).
Belder, "Microfluidics with Droplets" , Angew. Chem. Int., 44:3521-3522 (2005).
Chan, et al., "Formation of microdroplets in liquids utilizing active pneumatic choppers on a microfluific chip" , J. Micro.Ele. Mech Sys., 15:1492-1498 (2006).
Chen, et al., "High-Temperature Microfluidic Synthesis of CdSe Nanocrystals in Nanoliter Droplets" , J. Am. Chem. Soc., 127:13854-13861 (2005).
Fernandez-Nieves, et al., "Optically Anisotropic Colloids of Controllable Shape" , Adv. Mater, 17:680-684 (2005).
Fidalgo, et al., "Surface-induced droplet fusion in microfluidic devices" , Lab Chip, 7:984-986 (2007).
Fidalgo, et al., "From Microdroplets to Microfluidics: Selective emulsion separation in microfluidic devices", Angew. Chem. Int., 47:2042-2045 (2008).

(Continued)

*Primary Examiner* — Luan Van
*Assistant Examiner* — Maris R Kessel
(74) *Attorney, Agent, or Firm* — Pabst Patent Group LLP

(57) ABSTRACT

The present invention refers to a droplet-based miniaturized device with on-demand droplet-trapping, -fusion, and -releasing. The device makes use of different electrical fields for directing droplets into microwells and releasing them from the same. In another aspect, the present invention refers to a system comprising such a microfluidic device and a method of operating it.

19 Claims, 13 Drawing Sheets

(56) References Cited

OTHER PUBLICATIONS

Garstecki, et al., "Nonlinear dynamics of a flow-focusing bubble generator: An inverted dripping faucet", Physical Review Letters, 94:234502-1 (2005).
Hsiung, et al., "Micro-droplet formation utilizing microfluidic flow focusing and controllable moving-wall chopping techniques", J. Micromech. Microeng, 16:2403-2410 (2006).
Huang and Chang, "Selective Gold-Nanoparticle-Based Turn-On fluorescent sensors for detection of mercury (II) in aqueous solution", Anal. Chem.,78:8332-38 (2006).
Link, et al., "Geometrically medicated breakup of drops in microfluidic devices", Physical Review Letters, 92:054503-5 (2004).
Link, et al., "Electric control of droplets in Microfluidic devices", Agnew. Chem. Int., 45:2556-2560 (2006).
McDonald, et al., "Fabrication of microfluidic systems in poly(dimethysiloxane)" , Electrophoresis Review, 21:27-40 (2000).
Nie, et al., "Polymer particles with various shapes and morphologies produced in continuous microfluidic reactors", J. Am. Chem. Soc, 127:8058-8063 (2005).
Nisisako, et al., "Droplet formation in a microchannel network", Lab Chip, 2:24-26 (2002).
Pipper, et al., "Clockwork PCR including sample preparation", Lab Chip, 47:3900-3904 (2008).
Shi, et al., "Droplet-based microfluidic system for individual *Caenorhabditis elegans* assay", Lab Chip, 8:1409-1588 (2008).
Teh, et al., "Droplet microfluidics" , Lab Chip, 8:198-220 (2008).
Thorsen, et al., "Dynamic pattern formation in a vesicle-generating microfluidic device" , Phy. Review Letters, 86:4163-4166 (2001).
Wang, et al., "Efficient on-demand compound formation: from microfluidics to microdroplets as miniaturized laboratories", Small, 5:1149-1152 (2009).
Xu, et al., "Generation of Monodisperse Particles by Using Microfluidics: Control over Size, Shape, and Composition", Agnew Chem. Int Ed., 44:724-728 (2005).
Zheng, et al., "Screening of protein crystallization conditions on a microfluidic chip using nanoliter-size droplets", J. Am. Chem. Soc., 125:11170-11171 (2003).
Zimmermann, et al., "Capillary pumps for autonomous capillary systems" , Lab Chip, 7:119-125 (2007).

* cited by examiner (1)

(2)

(A)

(B)

DROPLET BASED MINIATURIZED DEVICE WITH ON-DEMAND DROPLET-TRAPPING, -FUSION, AND -RELEASING

CROSS-REFERENCE TO RELATED APPLICATIONS

This application claims the benefit of priority of U.S. provisional application No. 61/326,344, filed Apr. 21, 2010, the content of it being hereby incorporated by reference in its entirety for all purposes.

FIELD OF THE INVENTION

The present invention refers to the field of microfluidic engineering and biochemistry, in particular droplet manipulation and biochemical reactions in microfluidic devices.

BACKGROUND OF THE INVENTION

Miniaturized laboratory is a technological progress in biology and chemistry in recent years. Droplet microfluidics provides the miniaturizing technique to manipulate defined samples and reagents in microscale droplets. Stable and highly monodisperse droplets in the picoliter to nanoliter volume range can be generated on microfluidic platform and integrated to "Lab-on-a-chip" systems. Through transportation, fusion, split, sorting, samples and reagents confined in microdroplets can be sampled, analyzed, and with reaction occurred inside.

Microdroplets as naturally well-defined microreactors greatly prevent sample loss, cross-contamination, and concentration change due to diffusion. Owing to the high surface to volume ratio, microdroplets are granted with fast thermal transfer, fast and efficient mixing. At the same time the microdroplets are so tiny and able to be produced in a very fast rate which led their great applications in high throughput screening technology. With those unique advantages, microdroplets and droplet-based microfluidics have offered new routes to chemical and biochemical analysis, chemical and biochemical synthesis, chemical reactions, and material synthesis.

However, the existing microfluidic devices do not allow on-demand droplet manipulations integrated into it. Such on-demand droplet manipulations on single microfluidic platform allow the conduction of droplet based reactions with real time monitoring and also further analysis. On-demand methods also provide the selectivity of when to start the reactions and in a certain way, what reagents/particles to be involved in the reaction, what concentrations of reagents to be introduced.

It is therefore an object of the present invention to provide an improved microfluidic device which allows at least a partly droplet manipulation.

SUMMARY OF THE INVENTION

In a first aspect, the present invention refers to a microfluidic device for droplet manipulation. The microfluidic device may comprise (1) a droplet forming region, and (2) a microchannel. The microchannel can comprise an inlet region having a first end and a second end and being fluidly connected to the droplet forming region via the first end of the first inlet region. The microchannel can further comprise at least one microwell region comprising a first end and a second end, wherein the first end of the at least one microwell region is fluidly connected to the second end of the first inlet region. The microchannel can further comprise at least one connecting region having a first end and a second end, wherein the first end of the at least one connecting region is fluidly connected to the second end of the at least one microwell region. The at least one microwell region can comprise a segment of the microchannel which is connected to a microwell via a first opening of the microwell. The microwell can further comprise a second opening connecting the microwell with the at least one connecting region via a neck channel. The maximal dimension of the second opening of the microwell is adapted so that the flow resistance through the microwell is smaller than that through the neck channel during operation. The microfluidic device can further comprise (3) an outlet. The outlet can be fluidly connected to the second end of the at least one connecting region of the microchannel. The microfluidic device can further comprise (4) a first electrode, which is comprised partly or fully within the microwell, and (5) a second electrode arranged in proximity to the microchannel segment of the at least one microwell region opposite the first electrode in the microwell.

In one embodiment, the microfluidic device can further comprise a third electrode. The third electrode can be arranged in proximity to the microchannel of the at least one connecting region and next to the electrode comprised in the microwell of the at least one microwell region.

In one embodiment, the maximal dimension of the second opening is smaller than the maximal dimension of the microwell. For example, the maximal dimension of the second opening is three times smaller than the maximal dimension of the microwell.

In a further embodiment, the droplet forming region is comprised of at least two channels which are fluidly connected to each other at a junction.

In another embodiment, the droplet forming region comprises two channels fluidly connected to each other at a T-junction.

In another embodiment, the first opening of the microwell and the second opening of the microwell can have a shape which is independently selected from each other. The shape can include, but is not limited to a round shape, a rectangular shape, a square shape, or a polygonal shape.

In one embodiment, the microchannel can have a shape which includes, but is not limited to a round shape, a rectangular shape, a square shape, or a polygonal shape. Furthermore, the microchannel can have a maximal dimension of between about 10 μm to about 1000 μm.

In one embodiment, the microwell can have a shape which includes, but is not limited to a spherical shape, a rectangular shape, a polygonal shape, or a triangular shape.

In one embodiment, the microchannel in the at least one connecting region can have a U-shape.

In another embodiment, the microchannel can comprise multiple microwell regions and multiple connecting regions.

In one embodiment, the first electrode is attached to the wall of the microwell. Also, in one embodiment, the distance of the surfaces of each of the electrodes from a center line of the microchannel can be independently selected from each other and can be between about 100 μm to 1000 μm.

In still another embodiment, the microwell can comprise further electrodes for electrochemical determination of the content of a droplet which was trapped in a microwell during use.

In another aspect, the present invention is directed to a system. The system can comprise a microfluidic device for droplet manipulation as described herein. The system can further comprise a detection system for determining optical characterizing the properties of droplets flowing through the microfluidic device during operation. The system can further comprise at least one flow pump for controlling the flow of liquid in the microfluidic device.

In one embodiment, the detection system can be arranged to detect signals emitted by a droplet located in the microwell and/or to detect signals emitted by a droplet flowing through the microchannel.

In another aspect, the present invention is directed to a method of manipulating droplets in a microfluidic device. The method can comprise flowing a carrier fluid and an analytical fluid through a droplet forming region of a microfluidic device described herein to form droplets of analytical fluid. The carrier fluid and the test fluid may be immiscible with each other. Different alternatives for droplet manipulation with the microfluidic device described herein exist. For droplet trapping or fusion of different droplets a non-uniform electrical field between the first electrode and the second electrode can be applied. For trapping a droplet of analytical fluid flowing in the microchannel and passing before the first opening of the at least one microwell in the microwell a non-uniform electrical field can be generated. For fusing a droplet of analytical fluid trapped in the at least one microwell with another droplet of analytical fluid flowing in the microchannel and passing before the first opening of the at least one microwell a non-uniform electrical field can be generated. For example, the droplet of analytical fluid trapped in the microwell and the another droplet of analytical fluid can comprise the same or different chemical compounds. For release of a droplet trapped in the at least one microwell an electrohydrodynamic force can be generated between the first electrode, the second electrode and a third electrode arranged in proximity to the microchannel of the at least one connecting region and next to the electrode comprised in the microwell of the at least one microwell region.

In one embodiment, the flow rate within the microchannel can be between about 1 μl to 1 ml per hour. In another embodiment, the diameter of the droplet of analytical fluid is larger than the maximal dimension of the second opening of the microwell.

In another embodiment, the carrier fluid and/or the analytical fluid can be a gas or a liquid. For example, the liquid for the carrier fluid can be an oil.

In one embodiment, the analytical fluid comprises a dissolvent and at least one inorganic or organic molecule dissolved in the dissolvent.

BRIEF DESCRIPTION OF THE DRAWINGS

The invention will be better understood with reference to the detailed description when considered in conjunction with the non-limiting examples and the accompanying drawings, in which.

DETAILED DESCRIPTION OF THE PRESENT INVENTION

Figure 4:
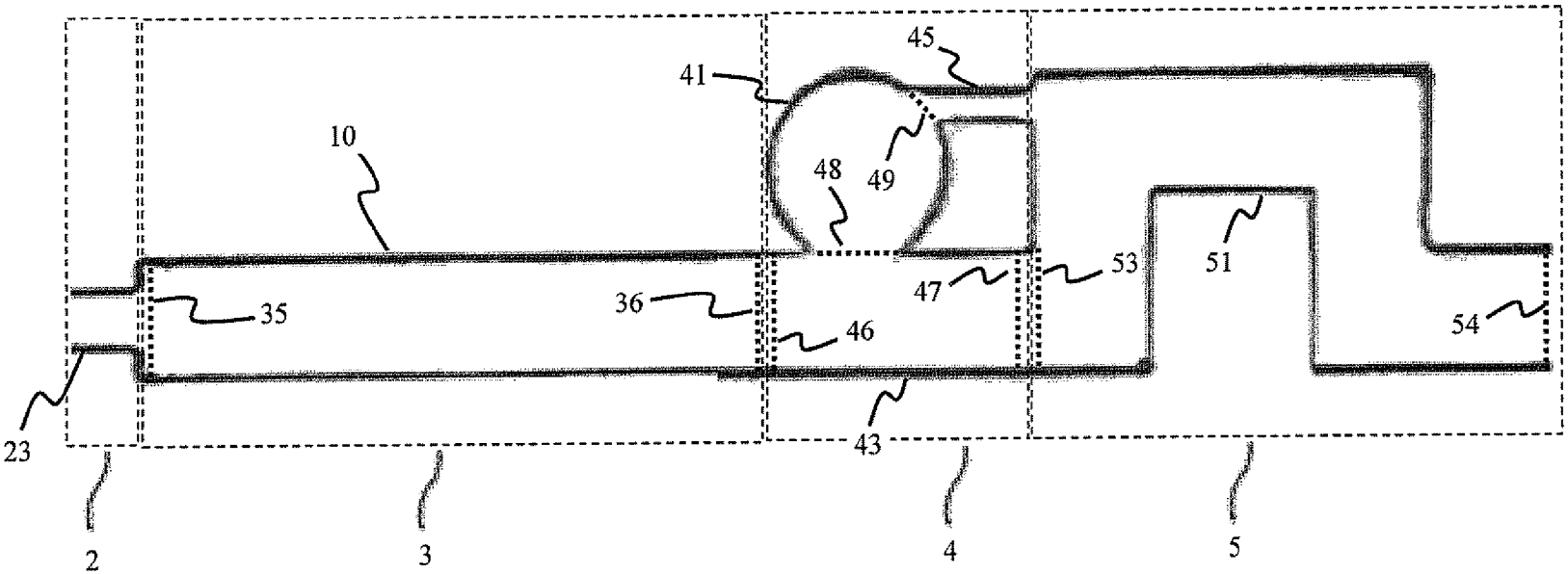
FIG. 4 shows a close-up of a layout of microfluidic platform for on-demand droplet manipulations for droplet based reactions without showing the electrodes 44, 42, 52 and the details of the droplet forming region 2.

One embodiment of the invention is described with reference to FIGS. 1 and 4. FIGS. 1 and 4 shows a microfluidic device 1 for droplet manipulation, such as droplet trapping, fusion of a trapped droplet with another droplet and release of a trapped droplet. Such a microfluidic device 1 can comprise a droplet forming region 2, and a microchannel 10. The microchannel 10 can comprise an inlet region 3 having a first end 35 and a second end 36 and being fluidly connected to the droplet forming region 2 via the first end 35 of the first inlet region 3. The microchannel 10 can further comprise at least one microwell region 4 comprising a first end 46 and a second end 47, wherein the first end 46 of the at least one microwell region 4 is fluidly connected to the second end 36 of the first inlet region 3. The microchannel 10 can further comprise at least one connecting region 5 having a first end 53 and a second end 54, wherein the first end 53 of the at least one connecting region 5 is fluidly connected to the second end 47 of the at least one microwell region 4. The at least one microwell region 4 can comprise a segment of the microchannel 43 which is connected to a microwell 41 via a first opening 48 of the microwell 41. The microwell 41 can further comprise a second opening 49 connecting the microwell 41 with the at least one connecting region 5 via a neck channel 45. The maximal dimension of the second opening 49 of the microwell 41 can be adapted so that the flow resistance through the microwell 41 is smaller than the flow resistance through the neck channel 45 during operation. The microfluidic device 1 can further comprise an outlet. The outlet can be fluidly connected to the second end 54 of the at least one connecting region 5 of the microchannel 10. The microfluidic device can further comprise a first electrode 42 which is comprised in part or fully in the microwell 41, and a second electrode 44 arranged in proximity to the microchannel segment 43 of the at least one microwell region 4 opposite the first electrode 42 in the microwell 41.

A microfluidic device described herein provides an array of electrodes to implement droplet trapping, fusion and release for each individual microwell comprised in the microfluidic device. For example, it allows on-demand droplet release to release a droplet that underwent a reaction in a microwell into the main stream for further analysis. The device employs both dielectrophoresis (DEP) force and Coulomb force to implement droplet release. Also, the droplet released into the main stream could be well join the flow of droplets flow in the main stream of the microchannel. This provides means to segment, index or address the droplet streams by the droplets released by their sizes or contents (i.e. color, fluorescence).

In such a microfluidic device all droplet manipulations are implemented within one single platform. Furthermore, all droplet manipulations are on-demand. The on-demand droplet release allows repeated usage of the same platform and allows unlimited tests to be conducted on one single platform. Individual electrodes array associated with each microwell allows implementing multiplexed microreactions at the same time. Arrayed microwells or reaction chambers allow the reactions to be monitored or presented at the same time. Control and test reactions can be conducted and monitored with one detection system, such as an optical microscope.

Figure 1A:
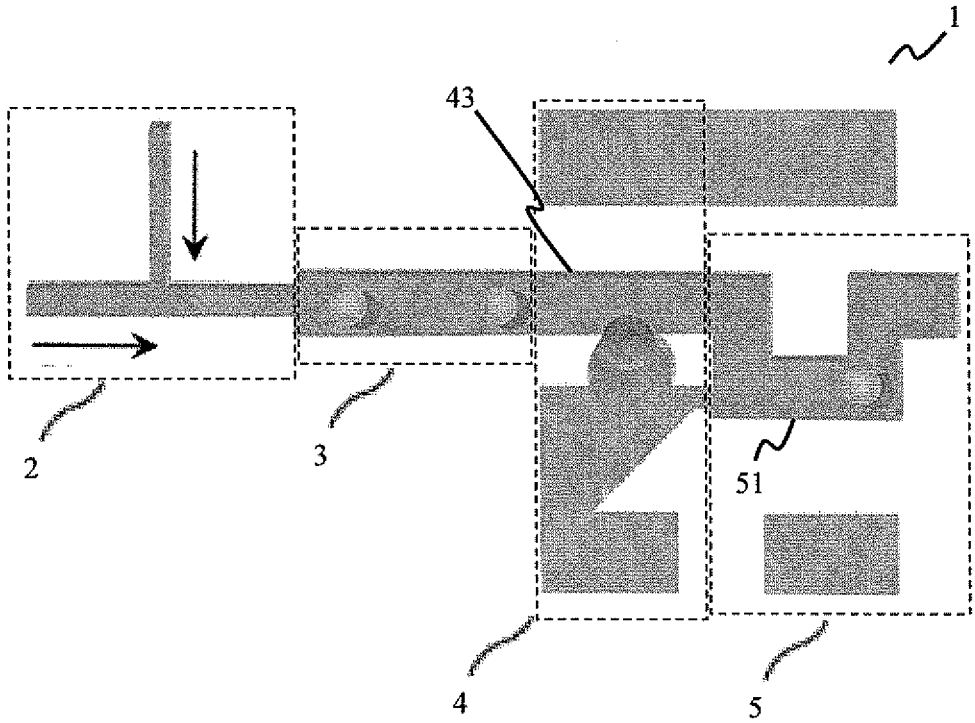
FIGS. 1(A) and (B) show the layout of microfluidic platform for on-demand droplet manipulations for droplet based reactions comprising a first 42, second 44 and third 52 electrode.
Figure 1B:
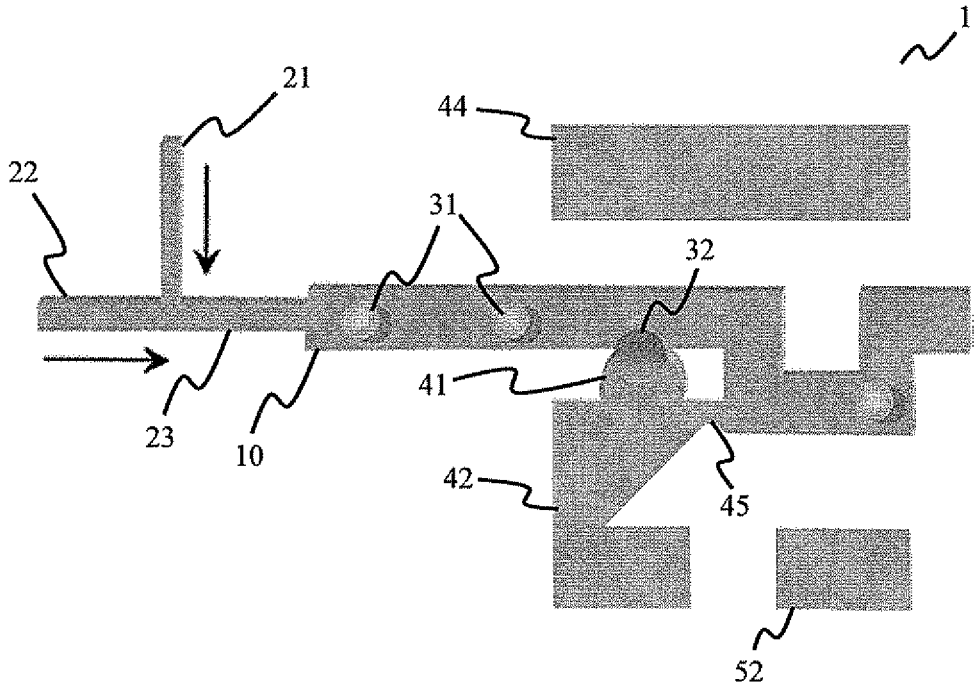

The microfluidic device 1 can further comprise a third electrode 52 for triggering release of droplets trapped in the microwell 41. The third electrode 52 can be arranged in the same plane as the first electrode 42. The third electrode 52 is not comprised in the microwell 41 but is arranged next to the first electrode 42 comprised in the microwell 41. Furthermore, if a third electrode 52 is comprised, the dimensions of the second electrode 44 are adapted so that the second electrode 44 is arranged opposite the first electrode 42 as well as the second electrode 44. An exemplary embodiment is illustrated in FIGS. 1(A) and 1(B). The distance of the third electrode 52 from the main microchannel 10 of the connecting region 5 is adapted to allow release of a droplet trapped in the microwell 41.

The maximal dimension of the second opening 49 of the microwell 41 can be adapted so that the flow resistance through the microwell 41 is smaller than the flow resistance through the neck channel 45 during operation. In one embodiment, the maximal dimension of the second opening 49 is smaller than the maximal dimension of the microwell 41. For example, in one embodiment, the maximal dimension of the second opening 49 is three times smaller than the maximal dimension of the microwell.

In other words the width of the neck channel 45 should be smaller compared with the dimension of the microwell 41 so that the flow resistance through the microwell is much smaller than that through the neck channel 45. In one embodiment, the maximal dimension of the microwell is at least three times larger than the maximal dimension or width of the neck channel 45.

Figure 10:
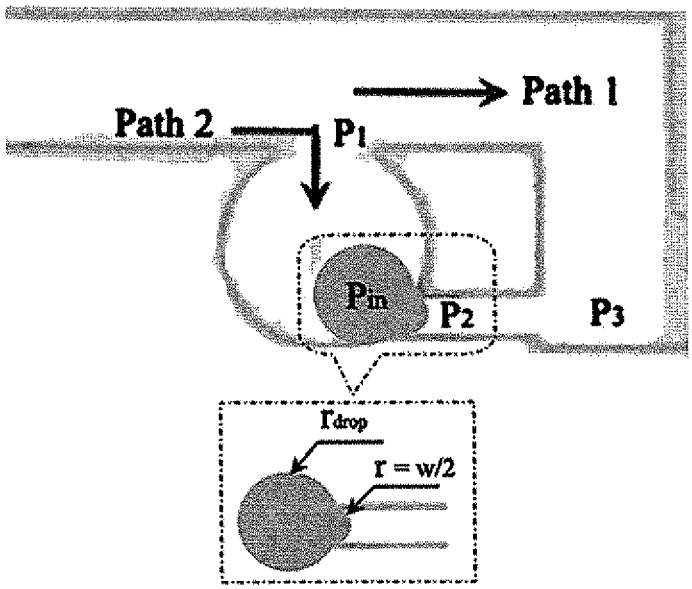
FIG. 10(A) shows a schematic drawing of one droplet trapping in the microwell.
FIG. 10(B) shows calculated minimum velocity of the main flow needed for the trapped droplet to escape from the narrow neck for droplets of various radii. As long as the flow velocity does not exceed this value for a given droplet, the trapped droplet will be safely stored in the microwell.
Figure 10:
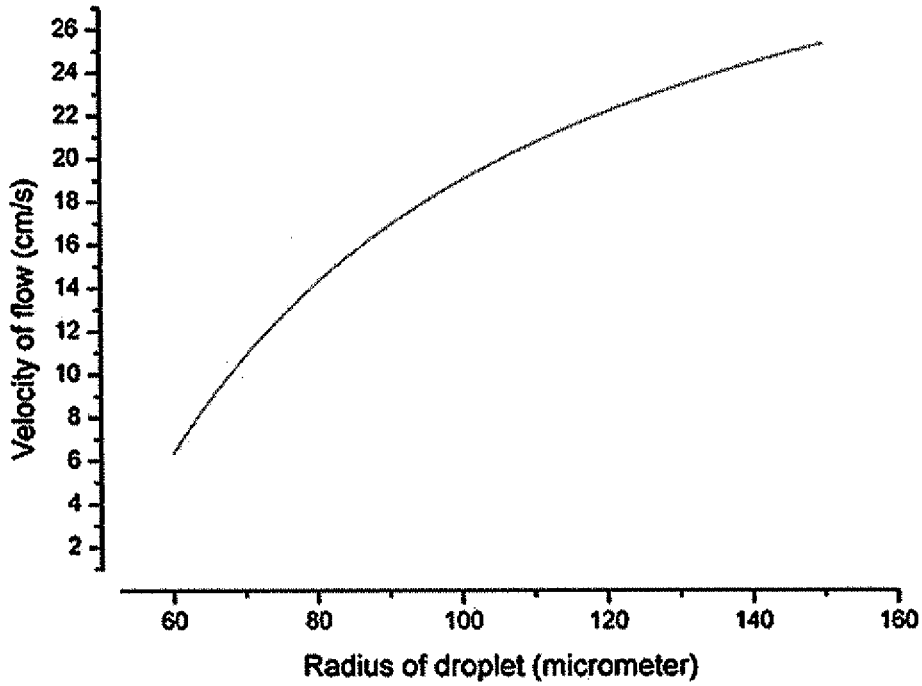
Figure 11:
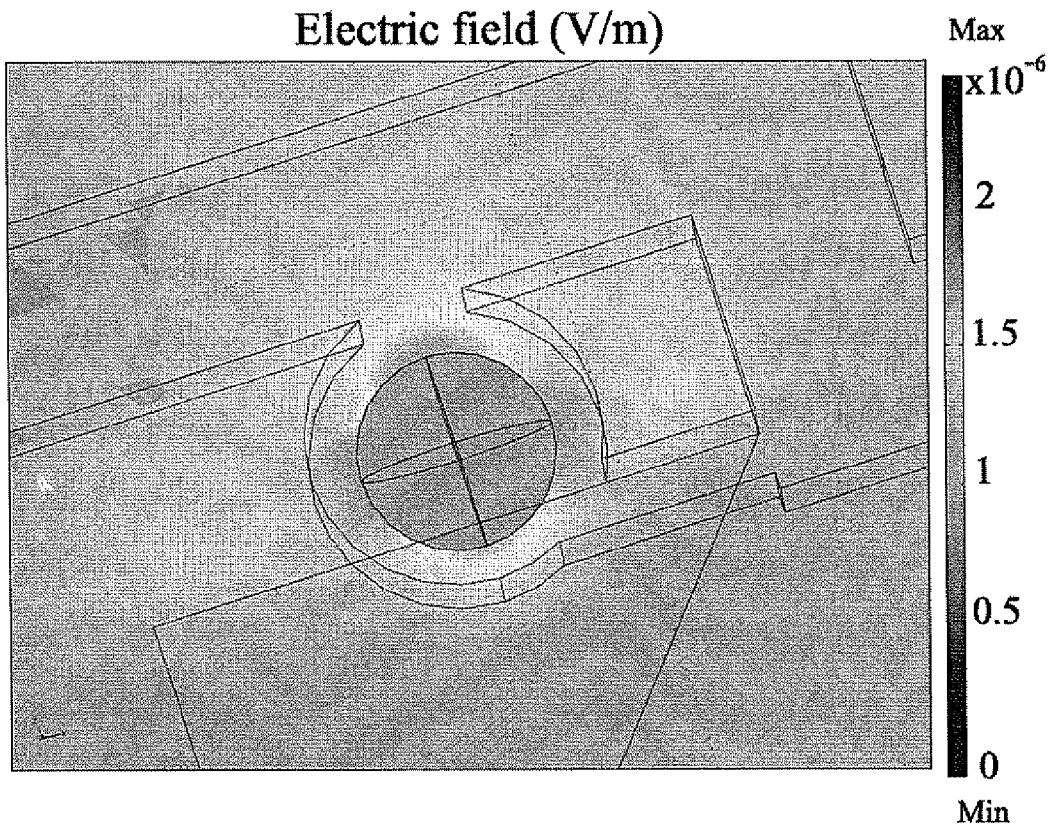
FIG. 11 illustrates a three-dimensional (3D) numerical simulation of the distribution of electric field around a droplet trapped in a microwell using the finite-element software (COMSOL MULTIPHYSICS).

Also, the dimensions of the neck channel 45 and the dimensions of the microchannel 10 determine the flow resistance through the two paths; namely path 1—through the microchannel 10 and path 2—through the neck channel 45 (see e.g. FIG. 10(A)). The flow resistance through the neck channel 45 should be higher than that through the microchannel 10, such that droplets prefer to flow through the microchannel 10 when no electrical force is applied. In formula this would mean:

$$\frac{R_1}{R_2} = \frac{L_1(6a_2 + 5b_2)a_2^2 b_2^3 (a_1 + b_1)^2}{L_2(6a_1 + 5b_1)a_1^2 b_1^3 (a_2 + b_2)^2} < 1 \qquad \text{Equation 1}$$

where $R_1$ is the flow resistance of path 1, $R_2$ is L is the flow resistance of path 2, $L_1$ is the length of the neck channel path 45 and $L_2$ is the length of the microchannel path 1, a and b are the depth and width of the microchannel 10, respectively.

Figure 3:
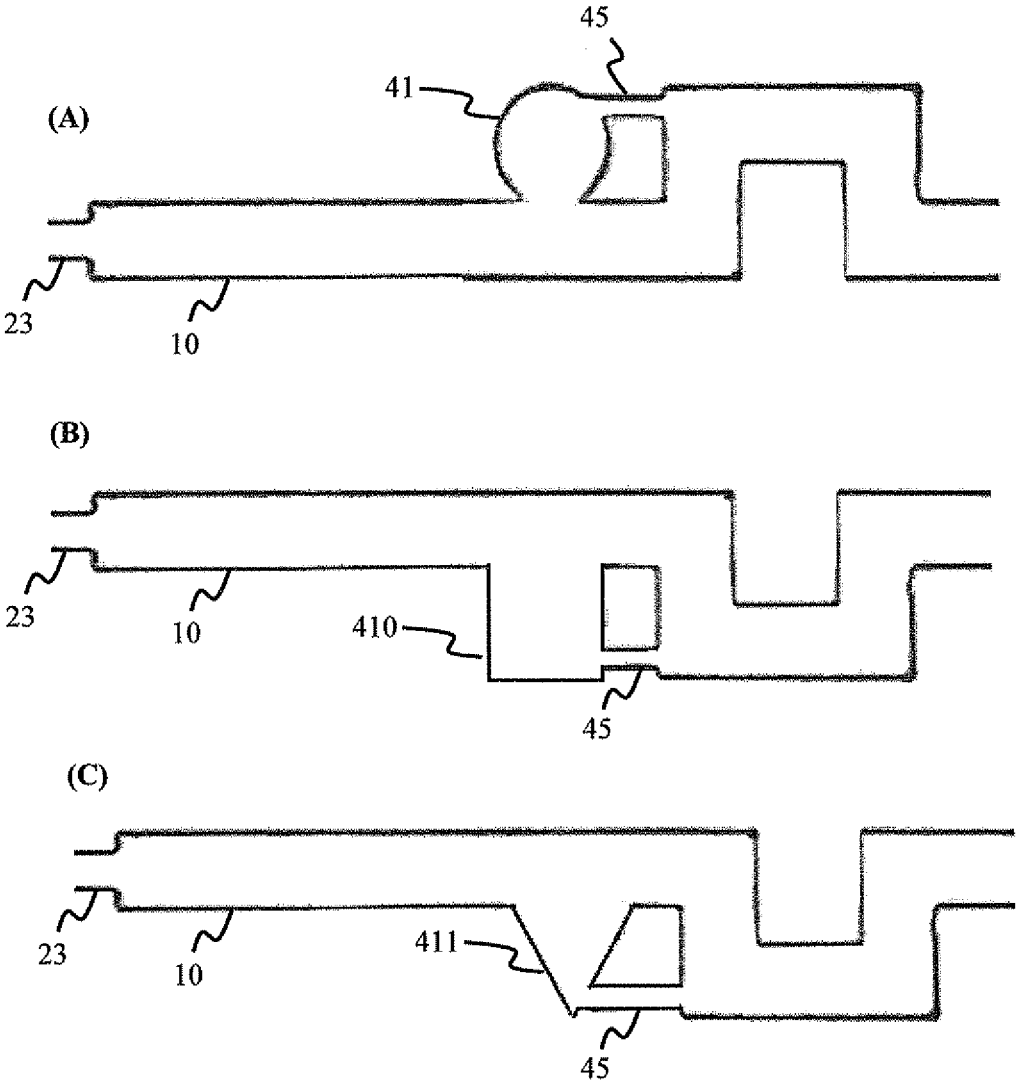
FIGS. 3(A), (B) and (C) show examples of differently shaped microwells 41, 410, 411 of a microfluidic device.

The maximal dimension of the microwell refers to the largest distance from one first point at the boarder of the microwell to another point at the boarder of the microwell which is the furthest away from the first point. In case the microwell has a round shape as the microwell 41 illustrated in FIG. 3(A), the maximal dimension is the diameter of the microwell 41 (see e.g. FIG. 9(B)). In case the microwell has a rectangular or a square base such as the microwell 410 illustrated in FIG. 9(B), the maximal dimension is the diagonal distance from, for example, the lower left corner of the microwell 410 to the upper right corner of the microwell 410. In case of an equilateral triangular shaped microwell 411 (see FIG. 9(C)) the maximal dimension is the distance between each of the side end points of the equilateral triangle.

Similar to the maximal dimension of the microwell 41, the maximal dimension of the second opening 49 refers to the maximal distance between the two points at the rim of the second opening 49 which are the furthest away from each other. In case of a round opening, the maximal dimension is the diameter of the second opening 49. In another embodiment, the maximal dimension of the second opening 49 and the neck channel 45 of the microwell 41 can be adapted so that the flow resistance through the microwell 41 is smaller than the flow resistance through the neck channel 45 during operation. In another embodiment, the second opening 49 of the microwell 41 is larger than the maximal dimension of the neck channel 45. The neck channel 45 can also be a tube having a cone shape with the largest opening, i.e. second opening which forms one end of the neck channel 45, facing the microwell 41 and the other pointed open end connecting to the microchannel 10 with the connecting region 5.

A microwell 41 can have any shape, even a non-geometrical shape. In one example, the shape of a microwell can include but is not limited to a polygon, such as a concave polygon, a convex polygon, a decagon, a digon, a dodecagon, an equilateral polygon, an equiangular polygon, a heptagon, a hexagon, an icosagon, an octagon, a pentagon, a regular polygon, or a star; a triangle, such as an equilateral triangle, an excentral triangle, a medial triangle, an obtuse triangle, a right triangle, or a Reuleux triangle; a trapezium, a quadrilateral, such as a rectangle or a rhombus; a circle, a circular sector, a crescent, an ellipse, an oval, or a semicircle, to name only a few. In one example shown in FIG. 1 the microwell 41 has a round shape comprising a first opening 48 and a second opening 49.

The volume of a microwell 41 can be adapted depending on the size of a single trapped droplet or the volume of several fused droplets which one intends to trap in the microwell. In general, the volume of the microwell is between about 1 nanoliter to about 1 μl.

The first opening 48 of the microwell 41 and the second opening 49 of the microwell 41 can have the same cross-sectional shape or a different shape. The cross sectional shape of the first opening 48 and the second opening 49 can have a geometrical shape or a non-geometrical shape. For example, the cross sectional shape of the first opening 48 and the second opening 49 can include, but is not limited to a polygon, such as a such as a concave polygon, a convex polygon, a decagon, a digon, a dodecagon, an equilateral polygon, an equiangular polygon, a heptagon, a hexagon, an icosagon, an octagon, a pentagon, or a regular polygon; a square, a rectangular, a circle, an oval, a triangle, such as an equilateral triangle, an excentral triangle, a medial triangle, an obtuse triangle, or a right triangle, to name only a few. The cross-sectional shape of the microchannel 10 can also be a geometrical shape or a non-geometrical shape. In one embodiment, the cross sectional shape of the microchannel 10 can be one of the cross sectional shapes described above for the first opening 48 and the second opening 49.

The microchannel 10 has a maximal cross-sectional dimension of at least 10 μm or between about 10 μm to about 1000 μm. In one embodiment, the maximal cross-sectional dimension is between about 100 μm to about 500 μm or between about 100 μm to about 400 μm. In one example, the maximal cross-sectional dimension is about 350 μm. In case of a round microchannel 10, the maximal dimension is the diameter of the microchannel 10. As described above, the maximal cross-sectional dimension of the neck channel 45 is in direct relation to the cross-sectional dimension of the microchannel 10. In general, the neck channel 45 can have a maximal cross-sectional dimension of between about 2 μm to about 200 μm or between about 10 μm to about 100 μm.

The microchannel segment in the connecting region 5 can have a U-shape 51. That means that after the connecting point between the second end 47 of the microchannel segment 43 of the microwell region 4 and the first end 53 of the microchannel 10 of the connecting region 5, the microchannel segment 51 makes a U-turn. At the peak of the U-turn shaped microchannel 51 the neck channel 45 extending from the microwell 41 joins the microchannel 10. However, the microchannel 10 in the connecting region 10 does not need to have a U-shape and the neck channel 45 does not need to connect to the microchannel 10 in the connecting region 5 at the peak of the U-shape.

Figure 5:
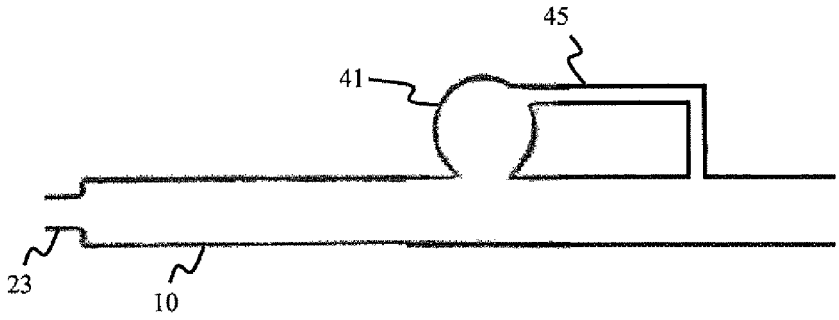
FIG. 5 shows an embodiment of a microfluidic device wherein the connecting region is straight and not U-shaped as in the embodiment of the microfluidic device shown in FIG. 1.

Firstly, the neck channel 45 can connect at any point to a U-shaped microchannel in the connecting region 5. Secondly, in case the microchannel 10 in the connecting region is not U-shaped but has any other shape, such as straight (see e.g. FIG. 5), the neck channel 45 can connect to the microchannel 10 in the connecting region at any point. The neck channel 45 can have any shape and any length as long as the flow resistance through the microwell 41 is much smaller than that through the neck channel 45.

Furthermore, the second opening 49 in the microwell connecting to the neck channel 45 can be arranged at any point within the microwell which is sufficiently far away from the first opening 48 to ensure the flow resistance as indicated above. In general, the opening of the neck channel 45 can be located anywhere in the microwell 41 as long as the end of the neck channel 45 is located at the downstream of the microwell opening 48. In this way the fluid flow direction in the neck channel will be from microwell 41 to the main channel 51.

Figure 6:
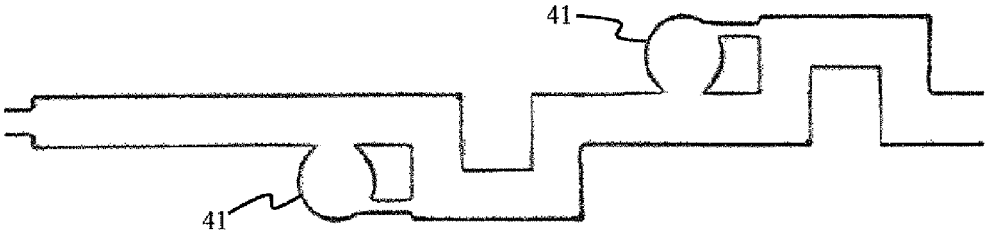
FIG. 6 shows an embodiment of a microfluidic device with more than one microwell.

In one embodiment, the microfluidic device 1 comprises not only one microwell 41 but multiple microwells 41 which are located along the entire length of the microchannel (see e.g. FIG. 6). As shown in FIG. 6 the microwells 41 also do not have to be positioned all in the same plane but can be positioned at different locations along the microchannel 10, such as at opposite sides as shown in FIG. 6. A microchannel 10 comprising several microwells 41 allows to either carry out several experiments in sequence with the same droplet or to carry out different experiments with droplets of the same content which are trapped in a microwell and thereafter each individually fused with droplets of different contents passing through the microchannel to initiate different reactions.

Figure 2:
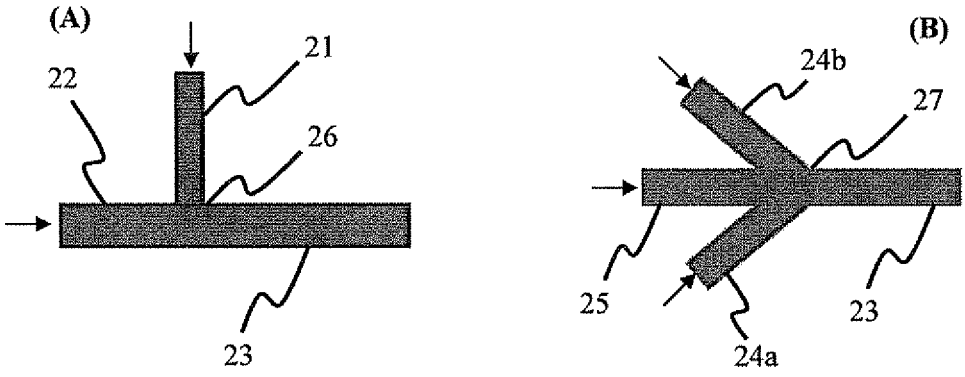
FIGS. 2(A) and (B) show exemplarily two alternative structures used for droplet formation in the droplet forming region.

The droplet forming region 2 can comprise a network of channels for forming droplets. Channel systems suitable for creating droplets are known in the art. Two exemplary systems are illustrated in FIG. 2. FIG. 2(A) shows a T-junction system for droplet formation while FIG. 2(B) shows a flow-focusing system for droplet formation.

In the embodiment illustrated in FIG. 2(A) a carrier fluid is continuously flowing into the droplet forming channel 23 through the inlet channel 21. At the crossing point 26 the carrier fluid coming from channel 21 meets the analytical fluid flowing into the droplet forming channel 23 through channel 22. The droplet forming at the crossing point 26 in the droplet forming channel 23 can have a size so that the droplet fills the entire channel 23 and the microchannel 10, i.e. the droplet is touching the wall. To avoid contamination from the walls of the channels 23, 10 already contacted by previous droplets passing through the channels 23, 10, the droplet can have a size so that it is completely surrounded by the carrier fluid.

FIG. 2(B) shows another configuration for droplet formation in which the carrier fluid flows through channels 24*a*, 24*b* into the droplet forming channel 23. The analytical fluid flows through the middle channel 25 and merges with the carrier fluid at the crossing point 27 to form a droplet in the droplet forming channel 23. Varying the flow rates between the channels carrying the carrier fluid and the analytical fluid allows varying the droplet size and rate of formation. For droplet formation the droplet forming region can comprise even more than three channels. The droplet forming region can also comprise valves for selecting droplets formed in different ways and/or with different content which are specifically selected to be guided into the microchannel. Those different droplets can then be addressed to different microwells.

For example, Hsiung, S.-K., Chen, C.-T., et al. (2006, Journal of Micromechanics And Microengineering, vol. 16, no. 11, pp. 2403) describe a method and apparatus for generating tunable micro-droplets in liquids using the combination of two microfluidic techniques, microfluidic flow focusing and a controllable moving-wall chopper. Another method of droplet formation is described by Chen, C.-T., Lee, G.-B., et al. (2006, Journal of Microelectromechanical Systems, vol. 15, no. 6, pp. 1492).

The microfluidic device may be made of glass, polypropylene (PP) or polytetrafluoroethylene (PFTE, Teflon). In some embodiments the microfluidic device may include or consist of an elastomer, such as a silicon polymer, e.g. polydimethylsiloxane, polypropylmethylsiloxane, polytrifluoropropylmethylsiloxane, or polyphenylmethylsiloxane.

In some embodiments at least a portion of the microfluidic device 1, e.g. the circumferential wall of the microchannel 10 and/or the microwell 41, is of matter that allows light to enter into the interior of the microfluidic device, including for instance the microwell 41. The term "light" is understood to include electromagnetic radiation of any wavelength, including a distinct wavelength, a set of distinct wavelengths or any region of the electromagnetic spectrum. Two examples of a region of the electromagnetic spectrum are visible light, corresponding to a wavelength range of about 400 to about 700 nanometers, and ultraviolet light, corresponding to a wavelength range of about 30 to about 400 nanometers. In some embodiments at least a portion of the circumferential wall of the microchannel 10 and/or the microwell 41 is of matter that allows light to emerge from the interior of the microchannel and/or the microwell.

A wall portion may for instance be transparent or translucent. Examples of suitable material for a wall portion that allows light to pass include, but are not limited to, glass, quartz and plastic material. Suitable plastic materials for the construction of a respective wall portion include, but are not limited to, polydimethylsiloxane (PDMS), polymethylmethacrylates (e.g. polymethyl-methacrylate (PMMA) or carbazole based methacrylates and dimethacrylates), polystyrene, polycarbonate, and polycyclic olefins. A further illustrative example of a material that is additionally suitable for the generation of a circumferential wall portion that allows light to pass only to a certain extent is fluoro-ethylen-propylen (FEP).

The surface characteristics of the channel walls and microwell walls exposed to the fluids flowing through the microfluidic device can be altered. A treatment that may be carried out to alter surface characteristics may comprise various means, such as mechanical, thermal, electrical or chemical means. A method that is commonly used in the art is a treatment with chemicals having different levels of affinity for the fluid(s) flowing through the microfluidic device. As an example, the surface of plastic materials can be rendered hydrophilic via treatment with dilute hydrochloric acid or dilute nitric acid. As another example, a polydimethylsiloxane (PDMS) surface can be rendered hydrophilic by an oxidation with oxygen or air plasma. Alternatively, the surface properties of any hydrophobic surface can be rendered more hydrophilic by coating with a hydrophilic polymer or by treatment with surfactants. Examples of a chemical surface treatment include, but are not limited to exposure to hexamethyldisilazane, trimethylchlorosilane, dimethyldichlorosilane, propyltrichlorosilane, tetraethoxysilane, glycidoxypropyltrimethoxy silane, 3-aminopropyltriethoxysilane, 2-(3,4-epoxy-cyclohexyl)ethyltrimethoxysilane, 3-(2,3-epoxy propoxyl)propyltrimethoxysilane, polydimethylsiloxane (PDMS), γ-(3,4-epoxycyclohexyl)ethyltrimethoxysilane, poly(methyl methacrylate), a polymethacrylate co-polymer, urethane, polyurethane, fluoropolyacrylate, poly(methoxy polyethylene glycol methacrylate), poly(dimethyl acrylamide), poly[N-(2-hydroxypropyl)methacrylamide] (PHPMA), α-phosphorylcholine-o-(N,N-diethyldithiocarbamyl)undecyl oligoDMAAm-oligo-STblock co-oligomer, poly(3,4-epoxy-1-butene), 3,4-epoxy-cyclohexylmethylmethacrylate, 2,2-bis[4-(2,3-epoxy propoxy)phenyl]propane, 3,4-epoxy-cyclohexylmethylacrylate, (3',4'-epoxycyclohexylmethyl)-3,4-epoxycyclohexyl carboxylate, di-(3,4-epoxy-cyclohexylmethyl)adipate, bisphenol A (2,2-bis-(p-(2,3-epoxy propoxy)phenyl)propane) or 2,3-epoxy-1-propanol.

Figure 7:
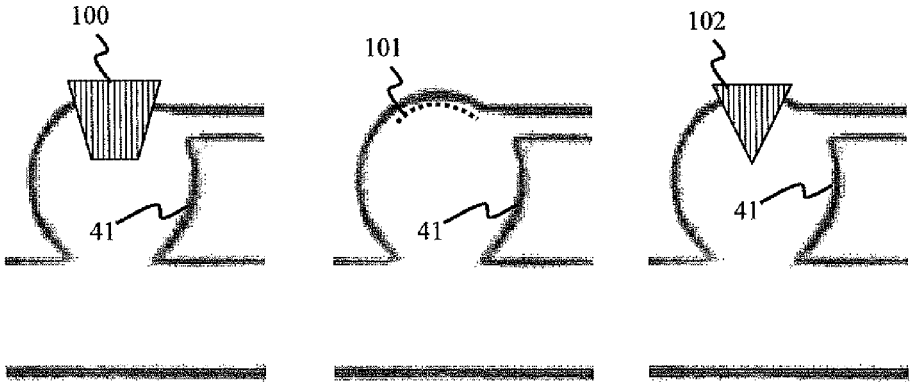
FIG. 7 shows microwells of microfluidic devices with differently shaped first electrodes 100, 101, 102.

The first electrode 42, second electrode 44 and third electrode 52 are arranged to apply voltages over the microchannel which result in trapping, fusion and release of droplets 31. The electrodes can have dimensions of between about 10 μm to about 10 millimeters. The first electrode is either fully embedded in the microwell or partly embedded in the microwell. Partly or fully embedded means that the position of the electrode is adapted to be able to contact a droplet trapped in a microwell. For this purpose, the electrode 42 can either rest against the circumferential wall of the microwell 41 or it forms part or a section of the circumferential wall of the microwell 41 in which a droplet 31 is to be trapped. An example of a first electrode 101 which is abutting the circumferential wall of a microwell 41 is shown in FIG. 7. In another embodiment, the first electrode 42 is partly lying outside the microwell 41 and partly lying inside the microwell 41. In one example, the first electrode 42 is protruding into the microwell 41 as illustrated for example in FIG. 1(B), and FIG. 7, 100, 102. The positioning of the first electrode 42 can be any where in and/or around the microwell as long as part of the first electrode 42 is exposed to the continuous phase (oil) transporting the droplets 31.

The first electrode 42, second electrode 44 and third electrode 52 can have any shape as long as this shape allows exerting an electrical field between the electrodes which allows manipulating the flow of the droplets 31 in the microfluidic device 1. Exemplary cross-sectional shapes of the first electrode 42 are shown in FIG. 7. In the first image in FIG. 7, the first electrode 100 has a trapezoidal shape, in the middle image the first electrode 101 has a curved shape, wherein the curved first electrode 101 is abutting the circumferential wall of the microwell 41. In FIG. 7, outermost right image the first electrode 102 has a triangular cross-sectional shape. The electrodes, such as the first electrode 42, can also have a rectangular shape.

In another embodiment, the cross sectional shape of the first electrode 42, the second electrode 44 and the third electrode 52 can include, but is not limited to a polygon, such as a such as a concave polygon, a convex polygon, a decagon, a digon, a dodecagon, an equilateral polygon, an equiangular polygon, a heptagon, a hexagon, an icosagon, an octagon, a pentagon, or a regular polygon; a square, a rectangular, a circle, a semicircle, an oval, a triangle, such as an equilateral triangle, an excentral triangle, a medial triangle, an obtuse triangle, or a right triangle, to name only a few. The shape of the first, second and third electrode can be the same or different from each other. The first electrode 42 is positioned so that the first electrode 42 and the second electrode 44 are arranged opposite each other. The second electrode 44 is arranged in direct proximity to the microchannel segment 43 opposite the microwell 41. Positioning of the second electrode 44 and third electrode 52 in proximity to the microchannel 10 means that the distance of the electrodes from the centre of the microchannel is independently selected for each electrode to be between about 100 μm to about 1000 μm. The distance between the electrodes can be freely varied. Varying the distance of the electrodes only requires adaptation of the driving voltage used for trapping and fusing of droplets. Position of electrodes can be varied and verified with simulation software (such as, COMSOL Multiphysics) so that the DEP and EHD are in the right combination for trapping, fusion and release of droplets 31. For effectively generating electric field, for example, electrodes can be placed close to the microwell and the center line of the microchannel, such as at a distance mentioned above of between about 100 μm to about 1000 μm.

The microwell 41 can further comprise further electrodes in addition to the first electrode 42 for electrochemical determination of the trapped droplet contents. In such a case the first electrode 42 and one or more of the further electrodes can be used for electrochemical determination.

For electrochemical detection electrodes can be embedded in each microwell for real time probing of trapped and fused droplets. Multiplex detections are implemented simply with switching/data acquiring circuits. Compared with conventional detection approaches such as fluorescence or colorimetric detections, electrochemical methods are highly sensitive and require less specific equipments. Since there is no concentration gradient within droplets, the mixing and reaction rate are fast and the reaction residues are well preserved within such nanoliter or microliter volume contents, the electrochemical detection is very accurate and representative for understanding reaction mechanisms.

Detectors for electrochemical detection are designed to ensure well-defined mass transport, minimal band broadening and electrical isolation (decoupling) from the high separation voltage (typically 1-4 kV). High sensitivity, tunable selectivity (via the applied potential), simple handling, long-term stability, and rigidity (to withstand multiple separations) are additional requirements for detectors used for electrochemical detection. In many configurations the detector based on different working electrode arrangements is placed outside or at the outer wall of a microwell 41 or microchannel 10, 43, 51.

The detector performance can be strongly influenced by the material of the working electrode. The working electrode is where the reaction of interest occurs. The selection of the working electrode depends primarily on the redox behavior of the target analytes and the background current over the applied potential region. Carbon, platinum or gold are the most common electrode materials for electrochemical detection. These include various forms of carbon (e.g. carbon paste or ink and glassy carbon), or thin-film and deposited/sputtered metal electrodes. Mercury electrodes are expected to facilitate the detection of reducible compounds. The power of amperometric detectors can be enhanced through a deliberate modification of the electrode surface. Such tailoring of the interfacial properties offers new levels of reactivity. In particular, electrocatalytic surfaces can be used to accelerate the electron-transfer reactions of species with a slow electron-transfer kinetics.

Electrochemical detection can work on different principles. Most commonly, it is performed by controlling the potential of the working electrode at a fixed value and monitoring the current as a function of time. The applied potential serves as the driving force for the redox process of the target analytes, while the current output reflects the extent of such electron-transfer reaction (and is thus directly related to the concentration of the compound reacted). Fixed-potential amperometric measurements have the advantages of ease of operation and freedom of background-current contributions. Positive and negative potentials have thus been used for monitoring oxidizable and reducible compounds, respectively. The applied potential is commonly selected by constructing a hydrodynamic voltammogram, through repeated injections of the analyte solution and recording the current at different potentials.

Although it is common to operate the detector on the limiting current plateau region, a lowering of the operating potential can be used for improving the selectivity or the detection limit. (In general, a high potential is more universal while a lower one is more selective.) The power of on-chip electrochemical detection can be improved by using more than one working electrode. For example, dual-electrode end-channel amperometric detection in the series mode can be used for enhancing the selectivity towards species undergoing chemically reversible redox reactions and for improving the peak identification in complex electropherograms. In this series configuration, the first ('upstream') electrode can be used to generate an electroactive species that is then more easily detected at the 'downstream' electrode.

Figure 8:
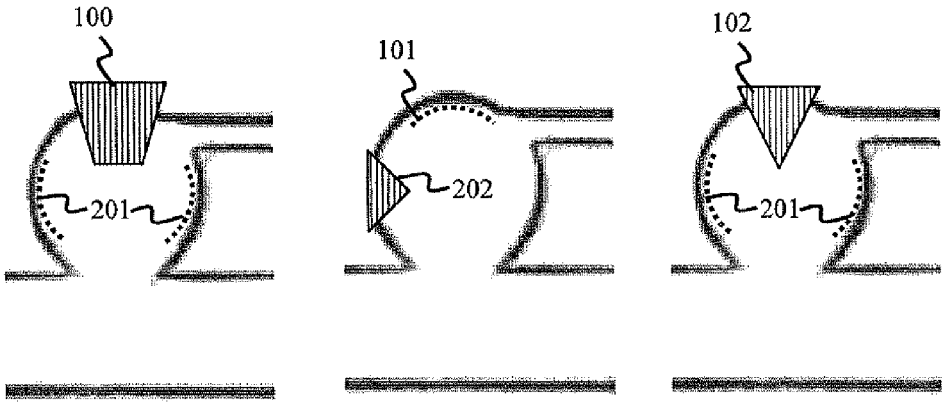
FIG. 8 shows microwells of microfluidic devices with (a) different locations for the first electrode 100, 101, 102 and (b) further electrodes 201, 202 for propping of trapped and fused droplets (not shown).

An additional electrode(s) for electrochemical detection can have the same or a different cross-sectional shape as the first electrode 42 described above. The additional electrodes can also further be embedded in the microwell 41 in the same manner as the first electrode 42. Exemplary positions and cross-sectional shapes of the additional electrode(s) 201, 202 are illustrated in FIG. 8. In the outermost left and right image of FIG. 8 the microwell 41 comprises two additional semicircular electrodes 201 which are abutting the circumferential wall of the microwell 41. In the middle image of FIG. 8, one additional triangular electrode 202 for electrochemical detection is shown. Other than the first electrode 42, the additional electrode(s) 201, 202 for electrochemical detection do not need to be positioned opposite the second electrode 44. Therefore, the at least one or the two electrodes for electrochemical detection can be positioned anywhere along the circumferential wall of the microwell 41. Those electrodes can also be placed outside the microwell in the microchannel for further downstream or upstream measurements.

In another aspect, the present invention refers to a system comprising a microfluidic device 1 for droplet manipulation, i.e. trapping, fusing and release, and a detection system for determining optical characterization of the properties of droplets flowing through the microfluidic device during operation. Such detection systems can comprise, but are not limited to microscopes, such as compound microscopes, stereomicroscopes, confocal microscopes, inverted microscopes, and laser microscopes; photometers for measuring irradiance or illuminance, or X-ray detectors for measuring radioactive compounds or radioactive labeled compounds comprised in droplets.

A photometer is used to detect scattered light intensity, absorption and fluorescence. A photometer is generally based on a photoresistor and exhibit a change in electrical properties when exposed to light. This change can be detected with a suitable electronic circuit. Also known as an illuminometer, a photometer also measures the relative intensity of a pair of lights. The intensity of light can be measured either visually or photoelectrically. A photometer measures the colors electronically rather than visually, giving more accurate results. Types of Photometer include, but are not limited to spectrophotometer or filter photometer.

Microscopes can include fluorescence macroconfocal detectors and fluorometric detectors both of them can be used together with charge-coupled device (CCD) cameras.

Those detection systems can be arranged along the microchannel 10 or in proximity to the microwell 41 so that they can, for example, direct or couple excitation light towards the droplets in the microchannel 10 and/or microwell 41. Further wore, the detection systems can receive and detect any radiation emitted from the compounds dissolved in the droplets. The system can further comprise micropumps or vacuum pumps for transporting the carrier fluid and analytical fluid through the microfluidic device 1.

In another aspect, the present invention is directed to a method of manipulating droplets in a microfluidic device which is described in the following with respect to FIGS. 1 and 4. The method can comprise: flowing a carrier fluid and an analytical fluid through a droplet forming region 2 of a microfluidic device 1 described herein to form droplets 31 of analytical fluid. The carrier fluid and the test fluid may be immiscible with each other. Different alternatives for droplet manipulation with the microfluidic device described herein exist. For droplet trapping or fusion of different droplets a non-uniform electrical field between the first electrode 42 and the second electrode 44 can be applied. For trapping a droplet 31 of analytical fluid flowing in the microchannel 10 and passing before the first opening 48 of the at least one microwell 41 in the microwell 10 a non-uniform electrical field can be generated. For fusing a droplet 31 of analytical fluid trapped in the at least one microwell 41 with another droplet of analytical fluid flowing in the microchannel 10 and passing before the first opening 48 of the at least one microwell 41 a non-uniform electrical field can be generated. For example, the droplet 31 of analytical fluid trapped in the microwell 41 and the another droplet 31 of analytical fluid can comprise the same or different chemical compounds. For release of a droplet 31 trapped in the at least one microwell 41 an electrohydrodynamic force can be generated between the first electrode 42, the second electrode 44 and a third electrode 52 arranged in proximity to the microchannel of the at least one connecting region 5 and next to the electrode 42 comprised in the microwell 41 of the at least one microwell region 4.

The droplet manipulations include droplet trapping, fusion and release and all manipulations can be on-demand. The droplet manipulations are achieved through the employment of electrohydrodynamic (EHD) force: a first electrode 42 and second electrode 44 generate a non-uniform electric field within the microchannel 10 and apply charges to droplets 31. This non-uniform electric field polarizes droplets 31 of analytical fluids passing by the microwell 41 and pulls them into microwells 41 for trapping or fusion when needed.

On the other hand, Coulomb force presented on droplets 31 due to charges carried by those droplets 31 is a major force during droplet release. A droplet 31 trapped in a microwell 41 can be fused with any specific droplet passing by the microwell 41 to trigger reactions. After reaction monitoring or incubation, fused droplets 31 in microwell 41 are released into the microchannel 10 for further manipulation in other microwells 41 or analysis with detection devices. The empty microwell 41 can then be used for next droplet 31 based reaction or detection. Although microwells 41 serve as reaction chambers, there is no contamination over them due to the system of immiscible fluids, such as water-in-oil emulsion system, that can be used herein.

In more detail, to selectively trap a droplet 31 into a microwell 41, a DC voltage step can be applied across the first 42 and second 44 electrode positioned along the microchannel 10 as shown for example in FIG. 1(B). In this way, a non-uniform electric field can be generated with the highest electric field at the bottom electrode exposed in the microwell 41. Droplets 31 passing by the microwell 41 are polarized, and thus are subject to dielectrophoretic force which affects their motion. A general expression for the dielectrophoretic force exerting on a spherical particle in a dielectric medium is given by $$\vec{F}_{DEP\ DEP}=4\pi\in r^3 Re[F_{CM}]\nabla\vec{E}^2 \qquad \text{Equation 2}$$

(where E is the electric field intensity, $\in$ is the dielectric constant of the carrier fluid, r is the radius of the particle and $Re[F_{CM}]$ denotes the Clausius-Mossotti factor, which is, for example, close to 1 for water drops in oil).

Figure 13:
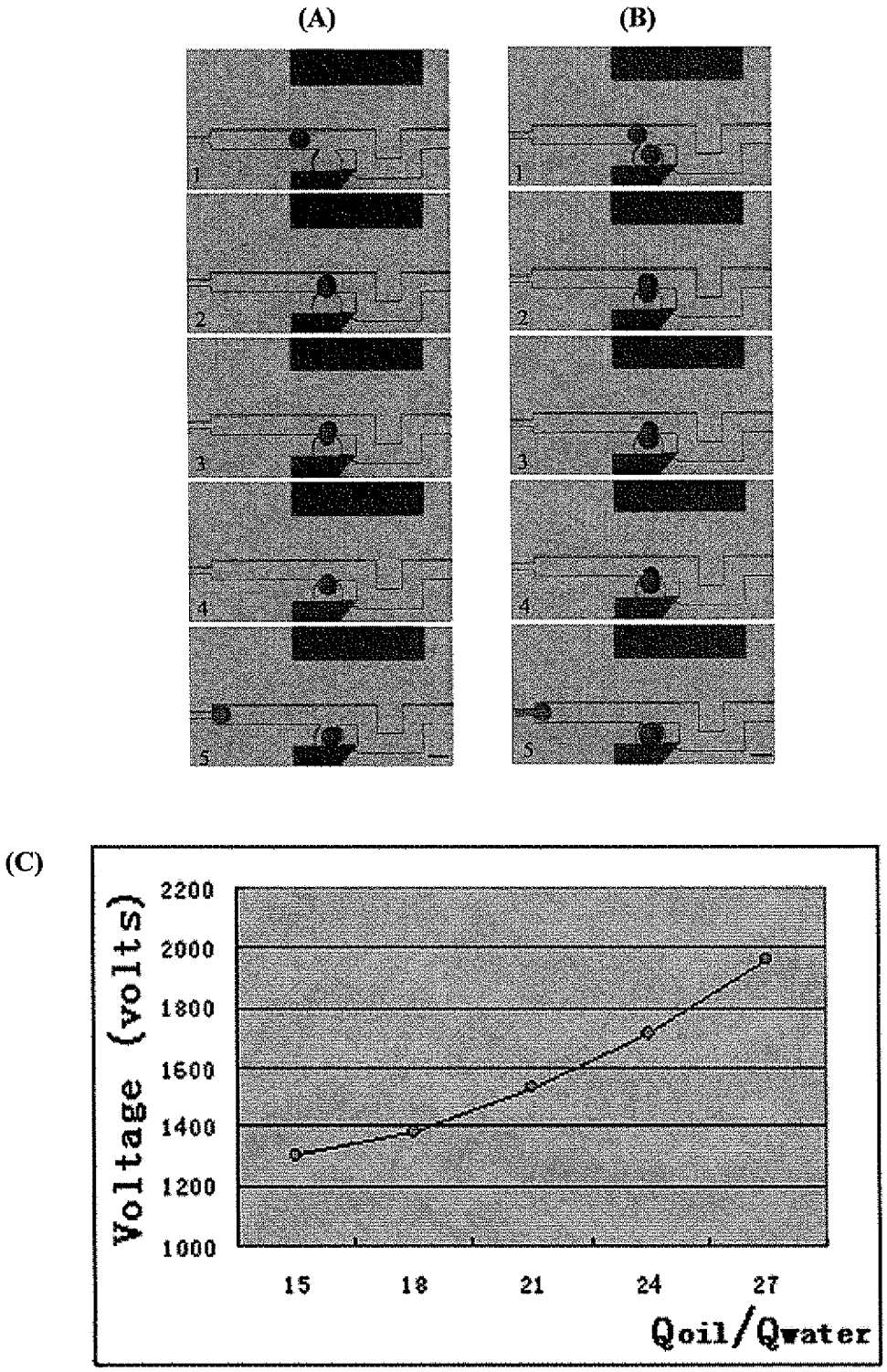
FIG. 13(A) shows sequenced images showing droplet trapping process (Scale bar 300 μm)
FIG. 13(B) shows sequenced images showing droplet fusion process (Scale bar 300 μm)
FIG. 13(C) shows driving voltages needed for droplet trapping under different flow conditions ($Q_{water}$ fixed at 10 μl/hour).

Since the dielectric permittivity of water is much higher than that of oil ($\in_{H_2O}\approx 81$, $\in_{oil}\approx 2.5$), a positive DEP force can pull the aqueous droplet 31 towards the high electric field region so that the droplet 31 can be trapped into the microwell 41. FIG. 13(A) shows exemplary sequence steps for droplet 31 trapping.

In a similar way, for droplet 31 fusion, by applying a DC electric field, a selected droplet 31 can be fused with the trapped droplet, and FIG. 13(B) shows sequential images of the two droplet fusion process. Once a droplet 31 for fusion is chosen, a DC electric field is switched on. The presence of the DEP force can push the selected droplet 31 towards the microwell 41 where the selected droplet 31 and the trapped droplet meet together, leading to the occurrence of droplet fusion. Therefore, additional samples/reagents can be introduced from the selected droplet 31 into the trapped droplet(s) for mixing and chemical reaction. After the fused droplet is trapped into the microwell, the electric field is turned off so that the next coming droplet will not be trapped into the microwell, and hence will pass by the microwell. This ensures that only selected droplets carrying predetermined samples/reagents can get fused with the trapped droplet for mixing and chemical reaction. Additionally, when needed, the fusion could be continuously triggered and the microwell could be completely filled.

Figure 14:
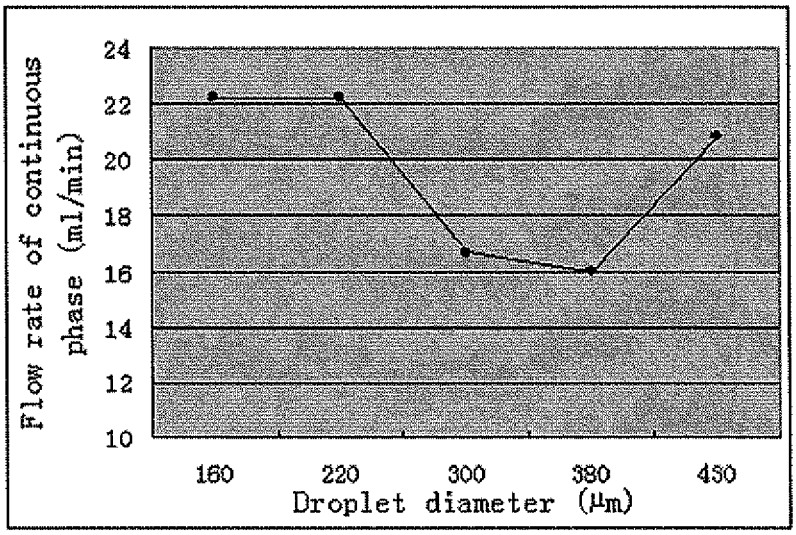
FIG. 14 illustrates the flow rate of the continuous phase needed for the release of droplets in different diameters.

The microfluidic device is designed such that the trapped droplet will not escape from the narrow neck channel 45 of the microwell 41. As studied and experimented, droplet trapped in the microwell 41 could be safely stored there as long as the flow of carrier fluid did not exceed a limit. By increasing the flow of the carrier fluid slowly, the flow rates needed to release droplets in different diameters are found as shown as in FIG. 14. Since those flow rates of oil phase are far higher than what employed in normal droplet flow experiments, the droplets trapped or fused in microwell 41 could always be safely stored there.

In general, the flow rate of fluid through the microfluidic device can be between about 1 μl to about 1000 μl per hour. In one embodiment, the flow rate for the different fluids, i.e. carrier fluid and analytical fluid is adjusted separately from each other depending on the frequency with which the droplets are formed and the size of the droplet desired. Methods for adjusting the droplet size and frequency of formation are known in the art.

Droplet release is carried out by incorporating an electrohydrodynamic (EHD) force by applying DC step voltage across the second electrode 44 and the first 42 and third electrode 52. As shown in the sequences of droplet release illustrated in FIGS. 15(A) and (B), when voltage applied, droplets starts to move towards the first opening 48, go into the microchannel 10, and flow away with the main stream of carrier fluid. Even if the droplet 31 is larger than the first opening 48, the droplet can deform and get itself through as shown in FIG. 15(B). The whole release process is in a very mild condition such that no droplet split occurs. On the other hand, the release process is fast enough such that the released droplet can join the series of other droplets 31 flowing in the microchannel 10. Such droplet manipulation also provides means to obtain droplets in desired sequence for indexing or addressing purpose.

Two kinds of EHD forces are involved in the droplet release. One is dielectrophoresis (DEP) force due to the presence of non-uniform electric field when applying voltage. Another is Coulomb force presented on the droplet due to the charges the droplet obtained from the first electrode 42 embedded in the microwell 41. The amount of charges acquired by the droplet on contacting the electrode is given by $$q=\left[\frac{\pi^2}{6}\right]4\pi r^2\varepsilon_1\varepsilon_0 E_0 \qquad \text{Equation 3}$$

where R is the radius of the droplet, $E_0$ is the electric field between the two electrodes and $\in_1$ is the dielectric constant of the continuous phase. The induced electrostatic force is then given by $$F = qE_0 = \left[\frac{\pi^2}{6}\right]4\pi r^2 \varepsilon_1 \varepsilon_0 E_0^2 \quad \text{Equation 4}$$

For example, the estimated electrostatic forces would then be 41 μN for a droplet of 300 μm in diameter and 73 μN for droplet of 400 μm in diameter.

Figure 16:
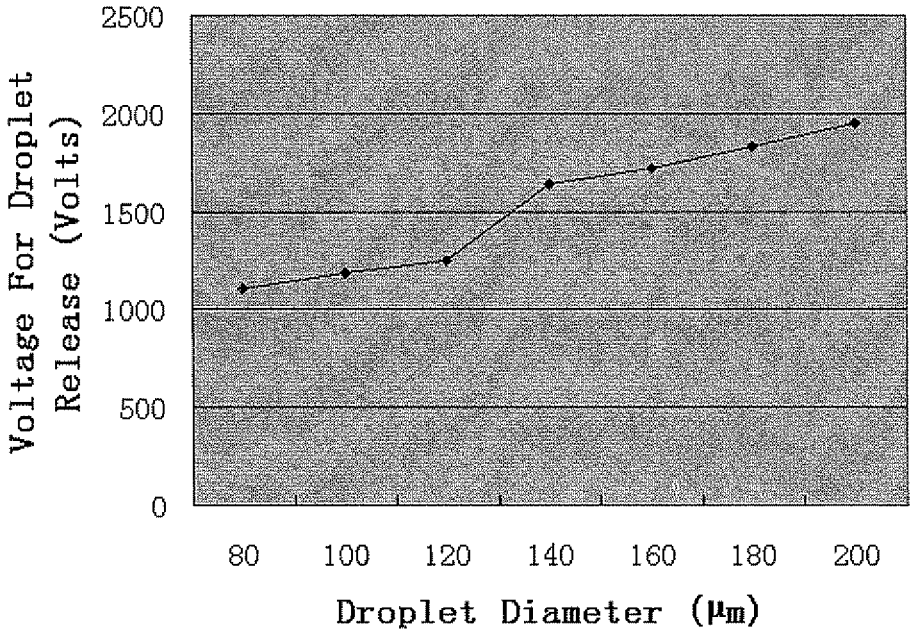
FIG. 16 shows the driving voltages needed for the release of droplets from a microwell in different diameters.

For droplet smaller than the first opening 48, a much lower driving voltage would be needed. FIG. 16 gives the driving voltages needed for the release of droplets of different diameters. Since the droplet can be swiftly released into a stream of droplets 31 flowing in the microchannel 10 without affecting the flow in the microchannel 10, this release method can be utilized to obtain multi-droplets in desired sequence for indexing or addressing purposes. Droplet series can also be easily segmented by droplets in different sizes, colors or other properties.

In general, there is no limitation to the volume of a droplet. In general the volume of the droplet is in the nanoliter or microliter range or about 1 nl or 10 nl to about 1 μl. In one embodiment the size is adapted so that at least the volume of 2, 3, 4 or 5 droplets fits into the microwell 41. However, in general, in order that a droplet trapped in a microwell 41 does not escape through the neck channel 45, the diameter of the droplet should be larger than the maximal dimension of the second opening 49. Furthermore, the volume of two single droplets should be less than the microwell 41 volume so that the fused droplet can be stored or contained in the microwell 41. For microwell 41 used to constrain a droplet the following rule can apply:

$$r \leq \frac{1}{2}\sqrt[3]{3R^2 * H} \quad \text{Equation 5}$$

where r is the radius of droplet formed in the microchannel 10, R is the radius of microwell and H is the channel depth.

The carrier fluid and the analytical fluid can be of a gaseous phase or a liquid phase. The fluids used herein are mostly liquid. The carrier fluid and the analytical fluid are two immiscible fluids since such fluids allow droplet formation in a microchannel. Immiscible means that two fluids do not mix, i.e. they do not form a homogeneous solution together. In the present case that means that the carrier fluid and the analytical fluid do not mix. Fluids which do not mix form two phases upon contact with each other. Therefore, a carrier fluid such as an oil disperses an analytical fluid and splits it into single droplets. The size and frequency of the droplets depends on the flow rates (represented by the Reynolds number Re) and the interfacial tension (represented by the capillary number Ca).

The formation of droplets can be shear-induced detachment. The balance of forces determines the final droplet size at the end of the droplet growth, which is at the moment of detachment. As described in WO 2006/098700, the droplet size $V_{droplet}$ and the volumetric flow rate of the analytical fluid $\dot{Q}_{sample}$ determine the frequency of droplet formation:

$$f = \dot{Q}_{sample}/V_{droplet}.$$

For example, the carrier fluid can be an oil, such as a light mineral oil, vegetarian oil, silicon oil, to name only a few. The analytical fluid can be a liquid comprising at least one compound which is supposed to take part in a reaction which takes place while the droplet is flowing through the microchannel 10 or is trapped in a microwell 41 or takes place after the droplet has been fused with another droplet trapped in a microwell, wherein the other droplet comprises the reaction partner, i.e. a compound, reacting with the compound in the first droplet. The term fluid in analytical fluid can also mean a suspension of solids in the analytical fluid. The analytical fluid can also comprise at least one or more inorganic and/or organic compounds which react with each other within the confines of the droplet or with other inorganic and/or organic compounds comprised in any other droplet or droplets with which the first droplet is supposed to fuse. The microfluidic device described herein and the on-demand trapping, fusion and release of droplets allows to carry out any kind of reaction which can take place in a fluid droplet and in a volume of a droplet used in such devices. It is also possible to carry out a sequence of reactions. For example, a first compound dissolved in an aqueous face of a first droplet fuses with another droplet comprising a first reaction partner of the first compound and afterwards the reacted compound dissolved in the now fused two droplets is released to be fused with another droplet in another microwell 41 or to be fused with another droplet within the same microwell 41.

The analytical fluid can also comprise living cells in a droplet which are to be reacted with test compounds which can be comprised in other droplets which are to be fused with cell comprising droplets trapped in a microwell for examination. Thus, this device also offers applications in cell research. Eukaryotic or prokaryotic cells can be reacted with test compounds to be guided through the microfluidic device described herein.

The microfluidic device with on-demand droplet manipulations (trapping, fusion and release) integrated allows the conduction of microscale reaction. Most importantly, the microreactions can be real time monitored, can be multiplexed and the post-reaction reagents can be further manipulated or analyzed. Such on-demand droplet manipulations in a single device can simplify droplet based reactions or detections. It can be used for an economical, efficient and effective lab-on-chip system for droplet based applications in chemical/biochemical analysis, chemical/biochemical synthesis, chemical reactions, high throughput screening and material synthesis, to name only a few technical applications.

The microfluidic device can also be used for cellular function analysis, the study of proteins for understanding disease mechanism and determining effective treatment approaches, and for droplet based multiple detection of proteins in solution.

The inventions illustratively described herein may suitably be practiced in the absence of any element or elements, limitation or limitations, not specifically disclosed herein. Thus, for example, the terms "comprising", "including", "containing", etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the inventions embodied therein herein disclosed may be resorted to by those skilled in the art, and that such modifications and variations are considered to be within the scope of this invention.

The invention has been described broadly and generically herein. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein.

Other embodiments are within the following claims and non-limiting examples. In addition, where features or aspects of the invention are described in terms of Markush groups, those skilled in the art will recognize that the invention is also thereby described in terms of any individual member or subgroup of members of the Markush group.

Experimental Section

Figure 9:
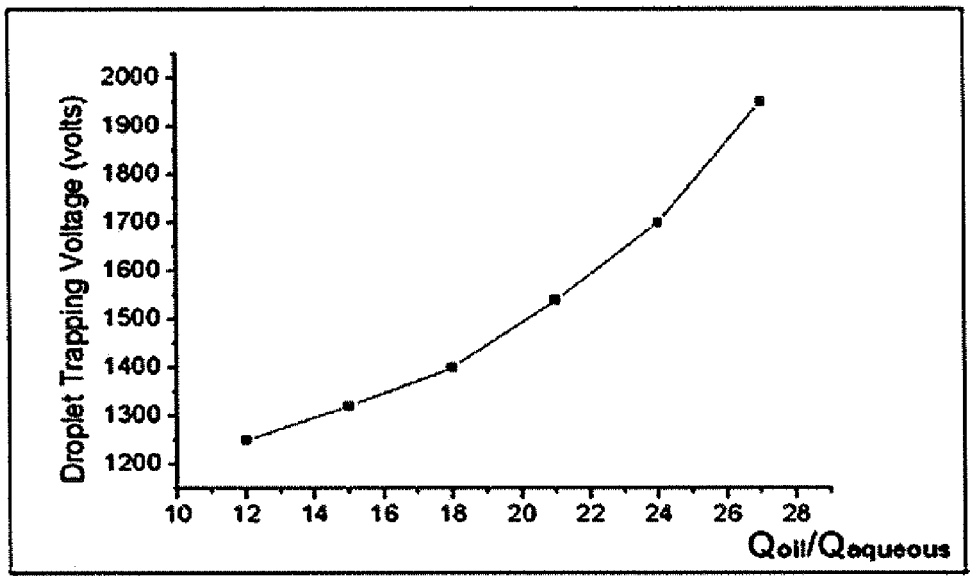
FIG. 9(A) shows a diagram of voltage versus $Q_{oil}/Q_{aqueous}$ illustrating the voltage needed to implement droplet trapping for different flow conditions.
FIGS. 9(B) & (C) show detailed dimensions of electrodes and droplet trapping and fusing structure in an embodiment of a microfluidic device.
FIG. 9(D) illustrates that without an electric field applied (top image) a droplet moves along the main microchannel while with an electric field applied (bottom image) a droplet is pulled into the microwell and trapped therein. Scale bar 300 μm.
Figure 9:
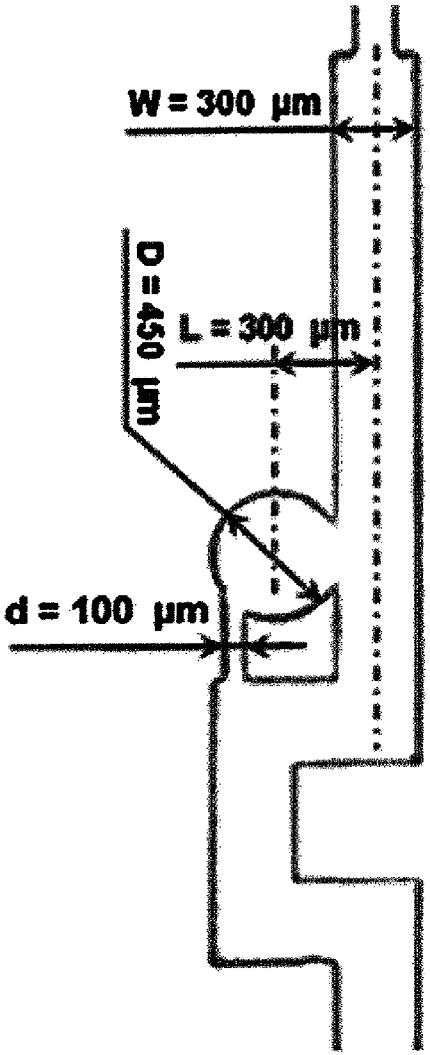
Figure 9:
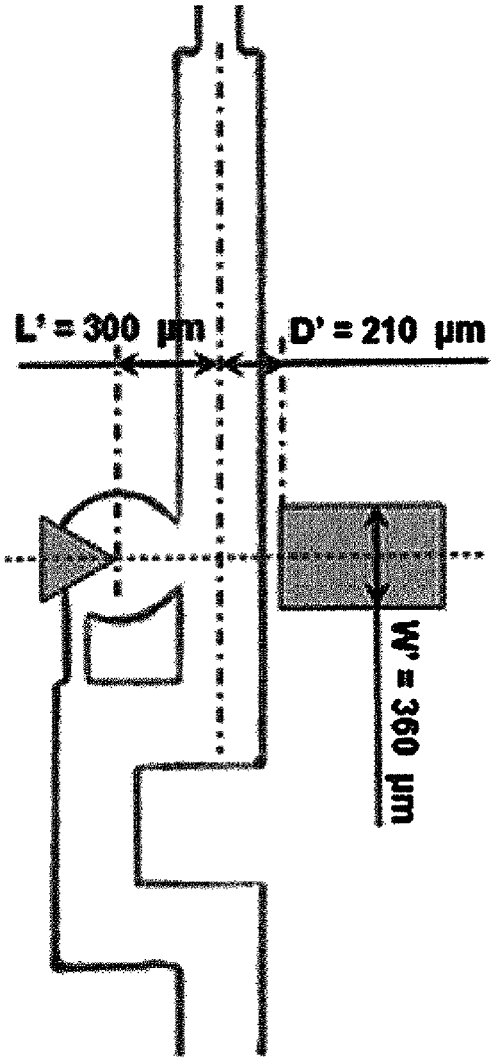
Figure 9:
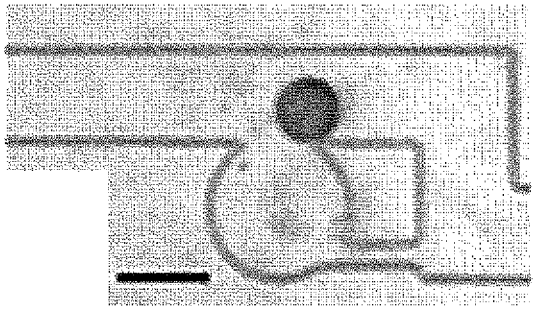
Figure 9:
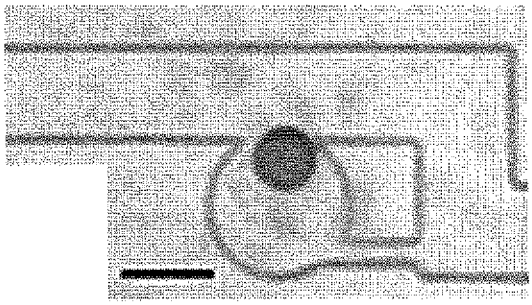

In one example a PDMS microfluidic device for generation, trapping, and fusion of droplets with application in droplet based on-chip assays was manufactured (see FIGS. 9(B) and 9(C)).

Fabrication of the Microfluidic Platform, Detail Dimension of the Microfluidic Platform, Setup of Experiment for Droplet Generation and Droplet Trapping/Fusion The microfluidic structure shown in FIGS. 9(B) to 9(C) was fabricated using soft lithographic technique with poly (dimenthylsiloxane) (PDMS) as building blocks. ITO Electrodes on glass was obtained by standard lithography process followed by ITO etching in $HCl:H_2O:HNO_3$ (4:2:1 by volume) solution. Microfluidic platform was formed by aligned bonding of PDMS slip with the ITO patterned glass assisted by oxygen plasma pretreatment. As shown in FIG. 9(C), the ITO electrode (first electrode) embedded in the microwell located with its 600 tip at center of the microwell in the microwell region. The opposite electrode (second electrode) has a rectangular shape (width=360 μm) with its lower edge 210 μm close to center of the main channel. The thickness of the ITO thin film was around 150 nm. The T-junction for droplet formation in the droplet forming region has a dimension of 150 μm (channel width) for the disperse phase and 100 μm (channel width) for the continuous phase at the phases merging region in the droplet forming region.

All microwells have a dimension of 450 μm in diameter and joint with the main channel with 300 μm channel width. The distance between the center line of the main channel and center of the microwell is 360 μm. All channels have the same depth as 400 μm. For the droplet formation, the flow rates are about 120 to about 300 μl/hour for the continuous phase and 10 μl/hour for the aqueous phase. For the droplet trapping, DC voltage pulse (1000 to about 2000 DC volts) was applied across each paired ITO electrodes.

The microfluidic structure thus obtained makes use of a DC electric field for selectively trapping droplets into a microwell. Furthermore, as the trapped microdroplet no longer moves with the bulk flow (i.e., oil phase), it was possible to achieve on-demand fusion of a selected droplet with the trapped droplet in the microwell with the aid of an applied electric field.

Such a device provides the following functions: (A) A droplet can be selectively trapped into a microwell, and the trapped droplet can be safely stored in the microwell, giving rise to flexibility in manipulation of such droplets. (B) The fusion of a selected droplet with the trapped droplet can allow not only for the introduction of additional reagents/samples into a targeted droplet, but also for attaining controllable chemical reactions within a droplet. (C) Importantly, since the fused droplet is trapped in the microwell, it is possible to achieve in-situ monitoring, real-time detection and study of the chemical reaction process without need of a high speed camera. This simplifies the droplet based detection.

With such an effectively controllable on-demand droplet trapping and droplet fusion method, it was possible to develop microfluidics based lab-on-chip systems for droplet reaction assays. It is expected that the device, method and technique presented herein can facilitate the wide application of droplet based microfluidics as a tool to study and optimize biological and chemical reactions (e.g., enzyme kinetic study, protein folding and crystallization etc).

As schematically shown in FIGS. 9(B) to 9(C), droplet generation, trapping and fusion are achieved with a PDMS based microfluidic platform, in which silicon oil purchased from Fluka is used as the oil phase while DI water with dissolved non-ionic dye from food industry for easy visualization is used as the aqueous phase (comprising analytical fluid).

The detailed fabrication process and geometric dimensions of such a microfluidic structure are explained above and illustrated in FIGS. 9(B) to 9(C). In brief, a T-junction is used for the droplet generation. Rayleigh-Plateau instability can cause the elongated aqueous phase threads to break up while the size of droplet and frequency of droplet generation can be controlled by the effects of channel dimensions and flow ratio of two liquid-fluid phases. The generated droplets flow downstream and pass by the microwells one by one as shown in FIG. 9(D).

The geometries of the microwell and the main channel were designed such that the droplet flowing through the main channel encounters less hydrodynamic resistance than the droplet flowing through the microwell. A simple analysis for the hydrodynamic resistance of these two flowing paths is provided in the following:

Flow Resistance Calculation to Determine how the Droplet Flow by Microwells

In FIG. 10(A), flow resistance of path 1 and path 2 are much different (path 1—without going through the microwell; path 2—going through the microwell). Ignoring the flow resistance of microwell opening (first opening of microwell) for path 2, and ignoring the flow resistance due to the 90 degree turn for path 1, the flow resistances for path 1 and path 2 could be estimated by:

$$R = 12\mu L\left[\left(1 + \frac{5}{6}\alpha\right)abR_H^2\right]^{-1} \quad \text{Equation 6}$$

where R is the flow resistance of the channel path, μ is the dynamic viscosity of fluid, L is the length of the channel path, a and b are the depth and width of the microchannel, respectively, $$\alpha = \frac{a}{b} \text{ or } \frac{b}{a}$$

such that $0 \le \alpha \le 1$, $R_H$ is the hydraulic radius of the microchannel defined as the ratio of the channel's cross-sectional area to its perimeter and given by $$\frac{ab}{a+b}.$$

For path 1, dimensions of L, a and b are 715 μm, 400 μm and 300 μm, respectively. For path 2, dimensions of L, a and b are 285 μm, 400 μm and 100 μm, respectively. Then the ratio of flow resistance of path 1 to that of path 2 is $$\frac{R_1}{R_2} \approx \frac{1}{10}$$

and the flow resistance for $R_1$ is $1.5\times10^{10}$ Pa*s*m$^{-3}$ (μ=mPa*s).

As a result, droplets prefer to flow through the microchannel 10 path instead of the microwell path as shown in FIG. 9(D)(1). To selectively trap a droplet into the microwell, a DC voltage step was applied across two ITO electrodes positioned near/within the microwells 41 as shown in FIG. 9(C). In this way, a non-uniform electric field was generated with the highest electric field at the tip of the bottom electrode in the microwell. Droplets passing by the microwell are polarized, and thus are subject to dielectrophoretic force which affects their motion.

A general expression for the dielectrophoretic force exerting on a spherical particle in a dielectric medium is given by $$\vec{E}_{DEP}=4\pi\in r^3 Re[F_{CM}]\nabla\vec{E}^2 \quad \text{(Equation 2)}$$

(where E is the electric field intensity, ∈ is the dielectric constant of the continuous phase, r is the radius of the particle and Re[$F_{CM}$] denotes the Clausius-Mossotti factor, which is close to 1 for water drops in oil in this experiment). In the present case, since the dielectric permittivity (also called dielectric constant) of water is much higher than that of oil ($\in_{H_2O}\approx81$, $\in_{oil}\approx2.5$), a positive DEP force can pull the aqueous droplet towards the high electric field region so that the droplet can be trapped into the microwell as shown in FIG. 9(D)(2).

The motion of droplet is dependent on the total external force $F_{ext}$ exerting on the droplet, and such force is determined by integrating the hydrodynamic stress tensor and the Maxwell stress tensor over the surface of the droplet. However precisely determining the hydrodynamic stress tensor and the Maxwell stress tensor is difficult because of the complex hydrodynamic flow and the electric fields. By varying the flow rates of the aqueous and oil phases and the applied DC voltages, the voltage level needed to enable the droplet trapping at different flow conditions ($Q_{oil}/Q_{aq}$) as shown in FIG. 9(A) was obtained quantitatively. Since a higher voltage applied can generate a stronger DEP force, the voltages imposed in FIG. 9(A) can certainly ensure successful droplet trapping. Instead of increasing the voltage level applied, high frequency AC voltage or even DC voltage pulses by simple operation of the on-off power supply can have the same effect on improving droplet trapping.

As a side remark, the effect from an increased voltage results from both increased flow rate and decreased droplet size. In a similar way, by applying a DC electric field, a selected droplet can be fused with the trapped droplet, and FIG. 13(B) shows sequential images of the two droplet fusion process. Once a droplet for fusion is chosen, a DC electric field is switched on. As analyzed earlier, the presence of the DEP force can push the selected droplet towards the microwell where the selected droplet and the trapped droplet meet together, leading to the occurrence of droplet fusion. Therefore, additional samples/reagents can be introduced from the selected droplet into the trapped droplets for mixing and chemical reaction. After the fused droplet is trapped into the microwell, the electric field is turned off so that the next coming droplet will not be trapped into the microwell, and hence will pass by the microwell. This ensures that only selected droplets carrying predetermined samples/reagents can get fused with the trapped droplet for mixing and chemical reaction. Additionally, when needed, the fusion could be continuously triggered and the microwell could be completely filled.

It is noted that the geometric dimensions of the microwell, the main and the branch channels are adapted for successful trapping and fusion of droplets in the microwell. The choice of these geometric dimensions should be in such a way that the trapped droplet will not escape from the narrow neck of the microwell. The Young-Laplace equation can be used to determine whether the trapped droplet can deform and thus escape from the narrow neck. Considering a trapped droplet as shown in FIG. 10(A), we can obtain an expression for preventing the trapped droplet from escaping from the narrow neck, and such expression is $$P_{in} - P_2 \left\{ \gamma\left(\frac{2}{w} - \frac{1}{r_{drop}}\right) \right. \quad \text{Equation 7}$$

where $P_{in}$ and $P_2$ are the local pressures indicated in FIG. 10(A), $r_{drop}$ and w/2 represent the radii of curvature of the part of droplet extended in the narrow neck of the microwell. Because of little volume of the part of droplet extended into the neck, $r_{drop}$ can be approximately chosen as the radius of the droplet with no extended part in the narrow neck. Furthermore, since the hydrodynamic pressure drops along the two paths shown in FIG. 10(A) are the same, the identity $(P_{in}-P_2)+(P_2-P_3)=(P_{in}-P_1)+(P_1-P_3)$ was obtained. Through performing the following mathematical derivations, it was possible to demonstrate that the condition for keeping the droplet from escaping into the narrow neck can be expressed as $$Q_{main} \le \frac{\gamma}{R_{path1}}\left(\frac{2}{w} - \frac{1}{r_{drop}}\right) \quad \text{Equation 8}$$

where $Q_{main}=Q_1+Q_2$ is the flow rate of oil phase before the junction and it is the sum of the flow rates of path 1 & 2 (see FIG. 10(A)). Equation 8 can lead to a plot of the fluid velocity defined as $Q_{main}$/(Channel_Depth×Channel_Width) versus $r_{drop}$ as shown in FIG. 10(B). As seen from FIG. 10(B), for the droplets ranging from 60 to 150 μm in radius, as long as the fluid velocity in the main channel is below 6 cm*s$^{-1}$, the trapped droplet can not escape from the narrow neck.

Deduction of Equation 1—Condition for Preventing the Droplet from Escaping

Considering a trapped droplet as shown in the FIG. 10(A), for preventing the trapped droplet from escaping from the narrow neck, it is necessary to have $$P_{in} - P_2 \left\{ \gamma\left(\frac{1}{r_{drop}} + \frac{2}{w}\right) \right. \quad \text{Equation 9}$$

where $P_{in}$ and $P_2$ are the local pressure indicated in FIG. 10(A), $r_{drop}$ and w/2 represent the radii of curvature of the part of droplet extended in the narrow neck of the microwell.

Because of little volume of the part of droplet extended into the neck, the $r_{drop}$ can be approximately chosen as the radius of the droplet with no extended part in the narrow neck. Since the hydrodynamic pressure drops along two flowing paths shown in FIG. 10(A) are the same, an identity is obtained:

$$(P_{in}-P_2)+(P_2-P_3)=(P_{in}-P_1)+(P_1-P_3)$$

Then $$(P_{in}-P_2)=(P_{in}-P_1)+(P_1-P_3)-(P_2-P_3) \quad \text{Equation 10}$$

$$\text{For path 1, } P_1-P_3=Q_1R_{path1}<Q_{main}R_{path1} \quad \text{Equation 11}$$

Where $Q_1$ and $Q_2$ are the flow rates of path 1 & path 2, respectively and $Q_{main}=Q_1+Q_2$ is the flow rate of oil phase before the microwell junction.

Applying Young's Laplace equation for the part of droplet left in the microwell, $$P_{in} - P_1 = \gamma \frac{2}{r_{drop}} \quad \text{Equation 12}$$

Here because of little volume of the part of droplet extended into the neck, the $r_{drop}$ can be approximately chosen as the radius of the droplet with no extended part in the narrow neck. For the part of droplet extended in the narrow neck, $$P_2 - P_3 = Q_{path2} R_{path2} > 0 \quad \text{Equation 13}$$

Here $Q_{path2} R_{path2} > 0$ as the neck channel is not fully blocked by the droplet.

Combining Supplementary Equation 3, 4 and 5, results in $$(P_{in} - P_1) + (P_1 - P_3) - (P_2 - P_3) < Q_{main} R_{path1} + \gamma \frac{2}{r_{drop}} \quad \text{Equation 14}$$

From equation 6 and 14, it shows that as long as the following is satisfied, $$P_{in} - P_2 = (P_{in} - P_1) + (P_1 - P_3) - (P_2 - P_3) < Q_{main} R_{path1} + \gamma \frac{2}{r_{drop}} \leq \gamma \left( \frac{1}{r_{drop}} + \frac{2}{w} \right) \quad \text{Equation 15}$$

the condition for non-escaping of the droplet is fulfilled.

Equation 15 leads to $$Q_{main} \leq \frac{\gamma}{R_{path1}} \left( \frac{1}{r_{drop}} + \frac{2}{w} - \frac{2}{r_{drop}} \right) = \frac{\gamma}{R_{path1}} \left( \frac{2}{w} - \frac{1}{r_{drop}} \right) \quad \text{Equation 16}$$

$R_{path1}$ can be calculated as $1.5 \times 10^{10}$ Pa*s*m$^{-3}$. With the interfacial tension $\gamma$ as 35 mN*m$^{-1}$, it results in $$\frac{\gamma}{R_{path1}} = 2.3 \times 10^{-12} \text{ m}^4 * \text{s}^{-1}.$$

Therefore, a plot of the velocity of flow can be obtained:

$$\left( \frac{Q_{main}}{\text{Channel_Depth} \times \text{Channel_Width}} \right)$$

vs. $r_{drop}$ as shown in FIG. 10(B)

$$\left( \text{velocity_of_flow} = 1900 \left( 0.02 - \frac{1}{r_{drop}} \right) \text{ cm/s}, \right.$$

here $r_{drop}$ is in μm).

In the present experiment, the generated droplets were in the range between 60 and 150 μm and the bulk fluid velocity in the main channel never reached 1 cm*s$^{-1}$. Thus, the trapped droplets could always be kept in the microwell. For a fused droplet with its radius larger than 200 μm, it could also be shown that an even higher flow rate is needed to push the droplet through the neck. Equation 8 gives a guideline for design of the droplet trapping structure. It is necessary to simultaneously manipulate both the channel depth and the neck width to obtain an optimized design for the droplet storage. Since each microwell for trapping and fusion of droplets can function alone, it is possible to build an array of completely independent microwells for droplet trapping, and fusion as well as reaction monitoring and analyses.

Electrodes are attached to an individual microwell for independent control of droplet trapping and fusion. By manipulation of droplets loading or droplets generation schemes, droplets can carry different reagents, and a multiplex on-chip droplet reaction assay can be developed. FIG. 6 shows such an array of microwells for droplet trapping, fusion, reaction, and storage, which can be used for on-demand droplet manipulation and analysis.

Thus an on-demand microfluidic droplet trapping and droplet fusion was demonstrated. By applying a controllable DC electric field, it is possible to selectively trap a droplet into a microwell and also fuse a targeted droplet with the already trapped droplet in the microwell. The design of such kind of microwells is in such a way that the droplet could be selectively moved into the microwell and the trapped droplet could be safely stored in the microwell. Additional droplet fusion control allows introducing sample/reagents into the trapped droplet when needed. Since the fused droplet is stored in the microwell, this allows for in situ and real-time study of chemical reaction inside a droplet. Such an on-chip microreaction system provides a powerful tool to study and optimize fast (e.g., millisecond) kinetic biological and chemical reactions.

Microfluidic Device for On-Demand Droplet Release

A microfluidic device which allows not only droplet trapping and fusion but also release of trapped and fused droplets requires the addition of a third electrode. An exemplary device which also allows on-demand droplet release is illustrated in FIGS. 1(A) & (B). Single T-junction microfluidic platform was used to incorporate one aqueous stream into a flow of oil phase (see FIGS. 1(A) & (B) and FIG. 2(A) for details of T-junction). FIGS. 1(A) & (B) shows the layout of the microfluidic platform and the position of electrodes embedded.

As for the microfluidic device illustrated in FIGS. 9(B) & (C) soft lithographic technique was used to fabricate microchannel structure with poly(dimenthylsiloxane) (PDMS) as building blocks. Gold electrodes on glass were obtained by standard lift-off microfabrication process. Then microfluidic platform was formed by aligned bonding of PDMS slip with the gold electrodes patterned glass slides assisted by oxygen plasma pretreatment. The main channel has a common depth of 400 μm and a channel width of 300 μm while the microwell has a diameter of 450 μm. The Au electrode embedded in the microwell (first electrode) located with its top edge 100 μm away from the center of the microwell. The opposite electrode (second electrode) has a rectangular shape (width=2000 μm) with its lower edge 840 μm away from the center line of the main channel. The bottom right electrode (third electrode) (800 μm in width) was 685 μm and 900 μm away from the center of microwell.

Figure 15:
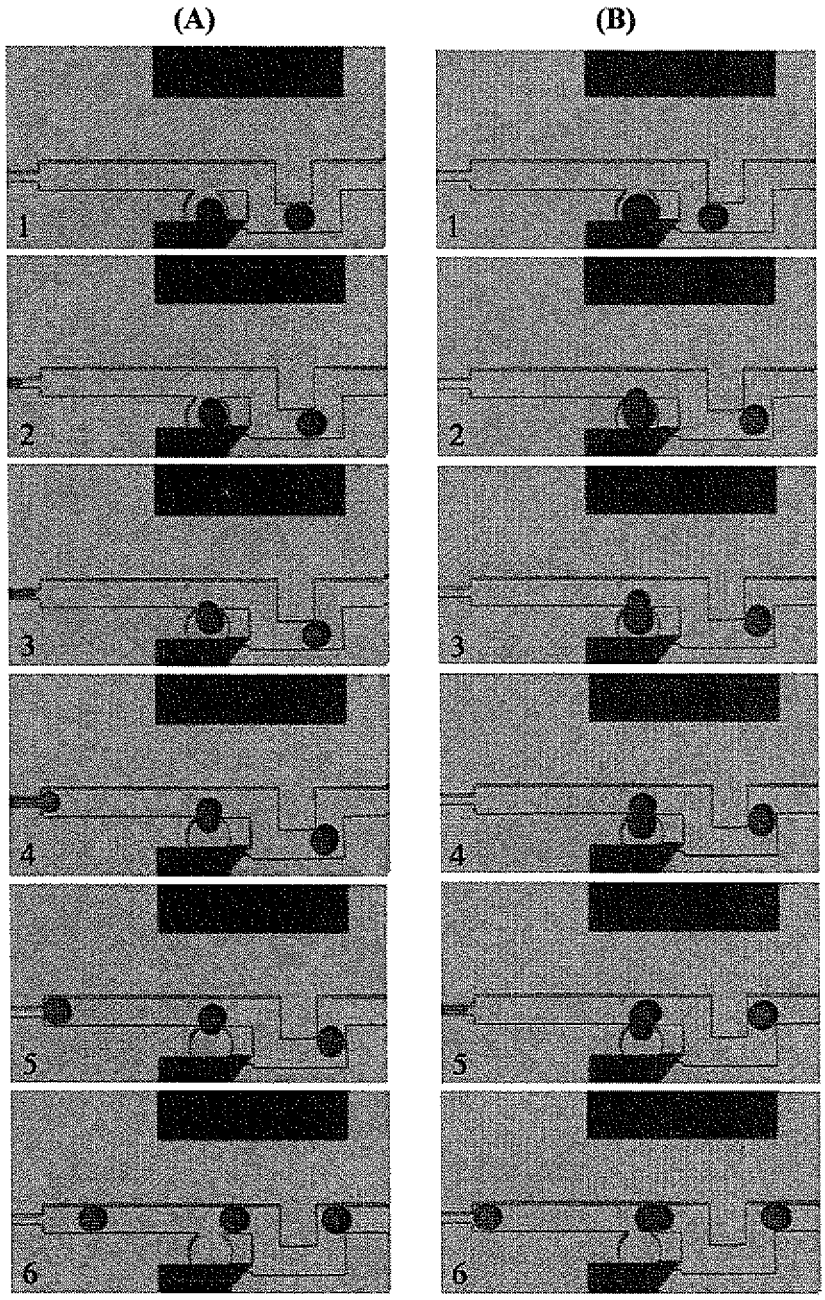
FIG. 15(A) shows sequenced images showing the release of small sized droplet trapped in microwell.
FIG. 15(B) shows sequenced images showing the release of large sized droplet trapped in microwell.

The on-demand droplet release is done by incorporating the electrohydrodynamic (EHD) force by applying DC step voltage across the top (second) electrode and the shorted two bottom electrodes (first and second electrode). As shown in FIGS. 15 (A) & (B), when voltage applied, droplets starts to move towards the upper exit, go into the main channel, and flow away with the main stream. Even if the droplet is larger than the upper exit, the droplet could deform and get itself through as shown in FIG. 15(B). The whole release process is in a very mild condition such that no droplet split occurred. On the other hand, the release process is extremely fast such that the release droplet can nicely join the series of other droplets. Such droplet manipulation also provides means to obtain droplets in desired sequence for indexing or addressing purpose.

Two kinds of EHD forces involved in the droplet release. One is dielectrophoresis (DEP) force due to the presence of non-uniform electric field when applying voltage. Another is Coulomb force presented on the droplet due to the charges the droplet obtained from the electrode embedded in the microwell. The amount of charges acquired by the droplet on contacting the electrode is given by:

$$q = \left[\frac{\pi^2}{6}\right] 4\pi r^2 \varepsilon_1 \varepsilon_0 E_0 \qquad \text{Equation 3}$$

where r is the radius of the droplet, $\in_0$ is the permittivity of free space; $E_0$ is the electric field between the two electrodes and $\in_1$ is the dielectric constant of the continuous phase. The induced electrostatic force is then given by $$F = qE_0 = \left[\frac{\pi^2}{6}\right] 4\pi r^2 \varepsilon_1 \varepsilon_0 E_0^2 \qquad \text{Equation 4}$$

The estimated electrostatic forces are then 41 μN for droplet of 300 μm in diameter and 73 μN for droplet of 400 μm in diameter.

For droplet smaller than the first opening of the microwell, a much lower driving voltage was needed which could be explained as less block of the droplet by the first opening of the microwell. FIG. 16 gives the driving voltages needed for the release of droplets in different diameters. Since the droplet could be released pretty fast into a stream of droplets flowing in the main channel without affecting the main stream flow, this can be utilized to obtain multi-droplets in desired sequence for indexing or addressing purpose. Droplet series could be easily segmented by droplets in different sizes, colors or other properties. When combining with droplet sorting and screening, such function will be significantly useful and it is an additional advantage for an on-demand droplet release mechanism.

Droplet Storage on Platform

The geometric dimensions of the microwell, the main and the branch channels are decisive for trapping and fusion of droplets in the microwell. The choice of these geometric dimensions is in such a way that the trapped droplet will not escape from the narrow neck of the microwell. As studied and experimented, droplet trapped in the microwell could be safely stored there as long as the flow of carrier fluid, such as an oil phase, did not exceed a limit. By increasing the flow of the oil phase slowly, the flow rates needed to release droplets from microwells in different diameters are found as shown as in FIG. 14. Since those flow rates of oil phase are far higher than what employed in normal droplet flow experiments, the droplets trapped or fused in microwell could always be safely stored there.

Detection of Mercury Ions in Water with Aid of Gold-Nanoparticles

Figure 12:
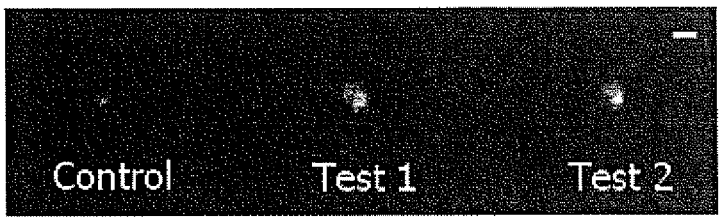
FIG. 12 illustrates the results of an experiment for detection of mercury ions through droplet reactions in an array of microwells of a microfluidic device referred to herein (Control—fluorescence image of a probe droplet (RB immobilized Au nanoparticles solution)); Test 1 & 2—fluorescence images after the reaction between probe droplets (RB immobilized Au nanoparticles solution) and target droplets (10 μM mercury ion solution). Scale bar 500 μm.

A microfluidic device as illustrated in FIGS. 1(A) & (B) was used for the detection of mercury ions in water with aid of gold-nanoparticles. In an array of microwells in a microfluidic device, aqueous droplets carrying rhodamine B (RB) immobilized Au nanoparticles coalesced with to-be-detected droplets for the detection of mercury ions. According to the reference Huang, C. C. and Chang, H. T. (2006, Anal. Chem., vol. 78, pp. 8332), the presence of mercury ions, RB molecules are released from the Au nanoparticles and the restored fluorescence of RB molecules can be detected by a fluorescence detection system, i.e., ProXPRESS 2D Proteomic Imaging System (PerkinElmer Inc.) as shown in FIG. 12. The detection system was arranged to detect signals of a microdroplet in the microwell or was placed to detect signals after release of the microdroplet form the microwell while flowing through the microchannel. Owing to the ability of on-demand manipulation of droplets at each individual microwell among the array of microwells, both control and test reactions can be conducted side by side and repeat different tests as many times as wanted. Thus, the results illustrated in FIG. 12 shows that mercury detection in droplet took place successfully as the same as the detection in bulk solution.

LIST OF REFERENCE SIGNS

1 Microfluidic device
2 Droplet forming region
3 Inlet region
4 Microwell region
5 Connecting region
10 Microchannel
21, 24*a*, 24*b* Inlet channel for carrier fluid
22, 25 Inlet channel for analytical fluid
23 Droplet forming channel
26, 27 Crossing point of carrier fluid and analytical fluid
31 Droplet
32 Release of trapped droplet
35 First end of inlet region
36 Second end of inlet region
41 Microwell
42, 100, 101, 102 First electrode
43 Segment of microchannel
44 Second electrode
45 Neck channel
46 First end of microwell region
47 Second end of microwell region
48 First opening of microwell
49 Second opening of microwell
51 U-shaped microchannel in connecting region
52 Third electrode
53 First end of connecting region
54 Second end of connecting region
201, 202 Further electrodes for electrochemical detection
410 Rectangular microwell
411 Triangular microwell

The invention claimed is:

1. A microfluidic device for droplet manipulation comprising:

a droplet forming region;

a microchannel; wherein the microchannel comprises:

an inlet region having a first end and a second end and being fluidly connected to the droplet forming region via the first end of the inlet region;

at least one microwell region having a first end and a second end, wherein the first end of the at least one microwell region is fluidly connected to the second end of the inlet region; and at least one connecting region having a first end and a second end, wherein the first end of the at least one connecting region is fluidly connected to the second end of the at least one microwell region;

wherein the at least one microwell region comprises a segment of the microchannel which is connected to a microwell via a first opening of the microwell, and wherein the microwell comprises a second opening connecting the microwell with the at least one connecting region via a neck channel; wherein the maximal dimension of the second opening is adapted so that the flow resistance through the microwell is smaller than the flow resistance through the neck channel during operation;

an outlet, wherein the outlet is fluidly connected to the second end of the at least one connecting region of the microchannel;

a first electrode which is comprised in part or completely in the microwell; and a second electrode arranged in proximity to the microchannel segment of the at least one microwell region opposite the first electrode in the microwell, wherein the first opening of the microwell and the segment of the microchannel that is connected to the microwell are located between the first and second electrodes;

a power source configured to apply a non-uniform dielectrophoretic force, wherein the first electrode and the second electrode are configured to generate a dielectrophoretic force on a droplet towards the microwell.

2. The device of claim 1, further comprising a third electrode arranged in proximity to the microchannel of the at least one connecting region and next to the electrode comprised in the microwell of the at least one microwell region.

3. The device of claim 1, the maximal dimension of the second opening is smaller than the maximal dimension of the microwell.

4. The device of claim 3, wherein the maximal dimension of the second opening is 3 times smaller than the maximal dimension of the microwell.

5. The device of claim 1, wherein the droplet forming region is comprised of at least two channels which are fluidly connected to each other at a junction.

6. The device of claim 4, wherein the droplet forming region comprises two channels fluidly connected to each other at a T-junction.

7. The device of claim 1, wherein each of the first opening of the microwell and the second opening of the microwell has a cross-sectional shape independently selected from the group consisting of a round shape, a rectangular shape, a square shape, and a polygonal shape.

8. The device of claim 1, wherein the microchannel has a cross-sectional shape which is selected from the group consisting of a round shape, a rectangular shape, a square shape, and a polygonal shape.

9. The device of claim 8, wherein the microchannel has a maximal dimension of between about 10 μm to about 1000 μm.

10. The device of claim 1, wherein the microwell has a shape which is selected from the group consisting of a spherical shape, a rectangular shape, a polygonal shape, and a triangular shape.

11. The device of claim 1, wherein the microchannel in the at least one connecting region has a U-shape.

12. The device of claim 1, wherein the microchannel comprises multiple microwell regions and multiple connecting regions.

13. The device of claim 1, wherein the first electrode is attached to the wall of the microwell.

14. The device of claim 1, wherein the distance of the surfaces of each of the electrodes from a center line of the microchannel is independently selected from each other and is between about 100 μm to about 1000 μm.

15. The device of claim 1, wherein the microwell comprises at least one further electrode for electrochemical determination of content of a droplet to be trapped in a microwell during use.

16. The device of claim 1, wherein the longitudinal axis of the segment of the microchannel that is connected to the microwell extends between the first and the second electrodes.

17. A system comprising:

a microfluidic device for droplet manipulation of claim 1; and a detection system for optical characterization of the properties of droplets flowing through the microfluidic device during operation.

18. The system of claim 17, wherein the system further comprises at least one micropump or vacuum pump for controlling the flow of liquid in the microfluidic device.

19. The system of claim 17, wherein the detection system is arranged to detect signals emitted by a droplet located in the microwell and/or to detect signals emitted by a droplet flowing through the microchannel.

* * * * *